US006677971B2

(12) United States Patent
Sasaki

(10) Patent No.: US 6,677,971 B2
(45) Date of Patent: Jan. 13, 2004

(54) RECORDING APPARATUS AND METHOD THEREOF

(75) Inventor: Yoshiharu Sasaki, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 100 days.

(21) Appl. No.: 09/987,092

(22) Filed: Nov. 13, 2001

(65) Prior Publication Data

US 2002/0063772 A1 May 30, 2002

(30) Foreign Application Priority Data

Nov. 14, 2000 (JP) ..... 2000-346867
Nov. 8, 2001 (JP) ..... 2001-343179

(51) Int. Cl.[7] ..... B41J 2/45; B41J 2/385
(52) U.S. Cl. ..... 347/238; 347/136

(58) Field of Search ..... 347/234, 238, 347/248, 130, 136; 359/246

(56) References Cited

U.S. PATENT DOCUMENTS 4,887,104 A * 12/1989 Kitano et al. ..... 359/246

FOREIGN PATENT DOCUMENTS

JP 11-277831 10/1999 ..... B41J/17/00

* cited by examiner

*Primary Examiner*—Hai Pham
(74) *Attorney, Agent, or Firm*—Sughrue Mion, PLLC

(57) ABSTRACT

Pixel shapes 90*a*' formed by respective optical shutters 90' are set to parallelograms, and an alignment of the parallelograms is set to overlap partially with recording loci K of parallelogram pixels formed by adjacent optical shutters when scanning is executed in the main scanning direction.

6 Claims, 12 Drawing Sheets

RECORDING APPARATUS AND METHOD THEREOF

BACKGROUND OF THE INVENTION

1. Field of the Invention

The present invention relates to a recording apparatus and recording methods that carries out the recording by irradiating a heat by a light beam, or the like onto a recording medium such as constructed by laminating a toner layer of a transfer sheet as the heat-mode sensitive material and an image receiving layer of an image receiving sheet.

2.Description of the Related Art

In recent years, there is employed a system that forms an image on a present paper by thermally transferring thermal material onto an image receiving sheet in response to image information by using a recording apparatus, that employs a recording head such as a laser light source, etc., and then passing the image receiving sheet and the present paper, superposed on this image receiving sheet, through an image transferring device to transfer the image formed on the image receiving sheet onto the present paper. In other words, an image receiving film is fixed to a recording medium fixing member (recording drum, surface fixing device, etc.) while directing its film surface to the outside, then a transfer sheet is also fixed onto the recording medium fixing member while directing its film surface to the image receiving film side to cover the image receiving film, and then a light such as the laser light, etc. is irradiated onto a laminated sheet consisting of the image receiving film and the transfer sheet (both are referred generically to as the "recording medium" hereinafter) like the image.

FIG. 6 is a schematic perspective view of the recording apparatus that uses the optical shutter as an example of the recording apparatus in the prior art. In FIG. 6, provided is a light source 70, and usually the laser light source, the light emitting diode, or the like is employed. A one-dimensional converting means 80 converts a point light source emission 71 from the light source 70 into a one-dimensional collimated light 81, and the lens, or the like is employed. An optical shutter device 90 controls the ON/OFF modulation of the collimated light 81 emitted from the one-dimensional converting means 80. In FIG. 6, ten optical shutters 90*a* are laterally aligned linearly.

In addition, A recording drum 60 is provided. The recording medium (the image receiving sheet 10 and the transfer sheet 20) is sucked by a recording drum sucking means, or the like described later, and fixed onto the recording drum 60. This recording drum 60 is rotated in the direction indicated by an arrow (main scanning direction), for example. In FIG. 6, in order to make it readily understand, the optical shutter device 90 is depicted to expand fully along the axis direction of the recording drum 60. But actually the width in the axis direction is smaller and also the optical shutter device 90 is constructed such that it can be moved in the direction perpendicular to the main scanning direction.

An operation of the recording apparatus show in FIG. 6 will be given as follows. The light is emitted from the light source 70 by applying the driving current and voltage corresponding to the input signal to the light emitting element of the light source 70. The emitted light 71 from the light source is irradiated to the optical shutter device 90 as a linear luminous flux 81 via the one-dimensional converting means 80.

The ON/OFF of respective optical shutters 90*a* are independently controlled in response to the input signal respectively such that transmitted lights 91 are emitted onto the recording mediums 10, 20 on the recording drum 60, that is being rotated in the main scanning direction, with controlled light quantities at timings assigned to respective lines to form two-dimensional images. In this case, ray controlling means (lenses, or the like) (not shown) are provided between the optical shutters 90*a* and the recording mediums 10, 20.

Therefore, a configuration of an operation of the optical shutters 90*a* will be explained with reference to FIG. 7(*a*). FIG. 7(*a*) shows the state that three optical shutters out of the 10 optical shutters 90*a* of the optical shutter device 90 in FIG. 6 are aligned. In FIG. 7(*a*), cl is a common signal line extended laterally in Figure, and ln, ln+1, ln+2 are selective signal lines that intersect perpendicularly with this common signal line cl (i.e., that are extended in the perpendicular direction to this sheet in this Figure respectively). Pn, Pn+1, Pn+2 are liquid crystal shutters that are provided to intersection points between the common signal line cl and the selective signal lines ln, ln+1, ln+2 respectively, whereby respective pixels are formed. In the liquid crystal shutters Pn, Pn+1, Pn+2, the liquid crystal layer is formed by injecting and sealing the liquid crystal formed of STN liquid crystal, FLC liquid crystal, or the like into the clearance space between the lower and upper glasses (not shown) by the known method. In this manner, patterns of the electrical signal lines are formed for respective pixels, and then the optical shutters ON/OFF (open/close)-control respective pixels independently by the selective signal lines ln, ln+1, ln+2. Then, patterns of respective signal lines are arranged not to generate the short-circuit. Also, the clearances (insulation areas) are provided between the pixels not to generate the short-circuit. Therefore, respective light quantities Ln, Ln+1, Ln+2 of the lights that are passed through the optical shutters Pn, Pn+1, Pn+2 when all the optical shutters Pn, Pn+1, Pn+2 are turned ON have distributions shown in FIG. 7(*b*) respectively.

Accordingly, a one-dimensional light quantity distribution TL of a total light quantity of the lights that are passed through respective optical shutters Pn, Pn+1, Pn+2 when all the optical shutters Pn, Pn+1, Pn+2 are turned ON is shown in FIG. 7(*c*). In this manner, in the optical shutters in the prior art, the break of the light quantity distribution is caused in the sub-scanning direction as shown in FIG. 7(*c*). As a result, in the recording apparatus having such optical shutters, if the recording is carried out by turning ON all optical shutters Pn, Pn+1, Pn+2, breaks (clearances) of the light quantity distribution in the sub-scanning direction appear between the pixels on recording lines Kn and Kn+1, Kn+1 and Kn+2 along the main scanning direction as shown in FIG. 7(*d*), and thus vertical stripes of unrecorded portions are produced.

In this manner, in the prior art, since the optical shutter device 90 in FIG. 6 employs the rectangular optical shutters 90*a*, the vertical stripes S of unrecorded portions are produced between the recording lines K along the main scanning direction when the recording is carried out by turning ON all the optical shutters 90*a*, whereby the image defect is caused.

In order to eliminate these clearances, recording conditions must be changed. However, if doing so, conversely it is impossible to get the predetermined density.

Also, in order to bury the clearances, the recording must be carried out by applying the overpower to such extent that the heat flows out in the lateral direction, otherwise the recording must be carried out at the low speed. However, these measures go against the needs of the times such as the energy conservation, the high-speed recording, etc.

SUMMARY OF THE INVENTION

Therefore, the present invention provides a recording apparatus in which the clearances of the light quantity distribution are not produced between the pixels in the sub-scanning direction when the recording must be carried out by turning ON all pixels and therefore vertical stripes of unrecorded portions are not produced when the recording is carried out in the main scanning direction and thus the image defect is not caused.

In order to overcome the above subjects, a recording apparatus in this invention comprises a recording medium fixing member for fixing a recording medium, a recording medium fixing member moving device for moving the recording medium fixing member by setting a moving direction of the recording medium as a main scanning direction, and a recording head which has a plurality of recording pixels that are aligned one-dimensionally, whereby recording of the recording medium is carried out by a laser beam projected from the recording head, wherein shapes of said plurality of recording pixels are set to parallelograms of which alignments are determined in such a way that a part of recording loci of one of said plurality of recording pixels and another part of recording loci of another one of said plurality of recording pixels are subjected to a scanning, said one of said plurality of recording pixels being located adjacent to said another one of said plurality of recording pixels.

A recording apparatus in this invention comprises a recording medium fixing member for fixing a recording medium, a recording medium fixing member moving device for moving the recording medium fixing member by setting a moving direction of the recording medium as a main scanning direction, a light source for emitting a light beam that is expanded one-dimensionally toward the recording medium fixing member, and an optical shutter device positioned between the light source and the recording medium fixing member and constructed by aligning at least one-dimensionally a number of optical shutters that control passing and reflection of the light beam, whereby recording of the recording medium is carried out to form a plurality of recording pixels by the light beam that is passed through the optical shutters, wherein shapes of said plurality of recording pixels are set to parallelograms of which alignments are determined in such a way that a part of recording loci of one of said plurality of recording pixels and another part of recording loci of another one of said plurality of recording pixels are subjected to a scanning, said one of said plurality of recording pixels being located adjacent to said another one of said plurality of recording pixels wherein pixel shapes formed by respective optical shutters are set to parallelograms and also an alignment of the parallelograms is set to overlap partially with recording loci of parallelogram pixels formed by adjacent optical shutters when scanning is executed in the main scanning direction.

A recording apparatus in this invention comprises a recording medium fixing member for fixing a recording medium, a recording medium fixing member moving device for moving the recording medium fixing member by setting a moving direction of the recording medium as a main scanning direction, a light source for emitting a light beam that is expanded one-dimensionally toward the recording medium fixing member, and an optical shutter device positioned between the light source and the recording medium fixing member and constructed by aligning at least one-dimensionally a number of optical shutters that control passing and reflection of the light beam, whereby recording of the recording medium is carried out by the light beam that is passed through the optical shutters, wherein pixel shapes formed by respective optical shutters are set to almost rectangles and also $$\theta 1 \leqq \theta 2$$

is satisfied, where θ1 is an angle between a line D connecting an upper right portion A of an n-th pixel and a lower left portion B of an (n+1)th pixel and a line E connecting the lower left portion B of the (n+1)th pixel and an upper left portion C of the (n+1)th pixel, and θ2 is an angle between a one-dimensional alignment direction of the optical shutters that are inclined along the main scanning direction and a sub-scanning direction.

A recording apparatus in this invention comprises a recording medium fixing member for fixing a recording medium, a recording medium fixing member moving device for moving the recording medium fixing member by setting a moving direction of the recording medium as a main scanning direction, a light source for emitting a light beam that is expanded one-dimensionally toward the recording medium fixing member, and an optical shutter device positioned between the light source and the recording medium fixing member and constructed by aligning at least one-dimensionally a number of optical shutters that control passing and reflection of the light beam, whereby recording of the recording medium is carried out by the light beam that is passed through the optical shutters, wherein pixel shapes formed by respective optical shutters are set to parallelograms and also the optical shutter device, by which the clearances are produced between recording loci of parallelogram pixels formed by adjacent optical shutters in a sub-scanning direction, is arranged to be rotated such that an angle θ3 between a line connecting an acute angle portion H on a right side of an n-th pixel and an acute angle portion J on a left side of an n+1-th pixel and a sub-scanning direction axis exceeds 90 degree.

A recording method in this invention provides with an image onto a recording medium with a laser beam projected from a recording head by fixing the recording medium onto a recording medium fixing member, causing the recording medium fixing member by a recording medium fixing member moving device to move in a moving direction of the recording medium being set as a main scanning direction, and aligning a plurality of recording pixels of a recording head one-dimensionally, wherein shapes of said plurality of recording pixels are set to parallelograms of which alignments are determined in such a way that a part of recording loci of one of said plurality of recording pixels and another part of recording loci of another one of said plurality of recording pixels are subjected to a scanning, said one of said plurality of recording pixels being located adjacent to said another one of said plurality of recording pixels.

A recording method of recording in this invention provides with an image onto a recording medium by a light beam that passes through optical shutters by fixing the recording medium onto a recording medium fixing member, causing the recording medium fixing member by a recording medium fixing member moving device to move in a moving direction of the recording medium being set as a main scanning direction, emitting a light beam, that expands one-dimensionally, from a light source to the recording medium fixing member, and arranging an optical shutter device, that is constructed by aligning a large number of optical shutters at least one-dimensionally, between the light source and the recording medium fixing member to control a passing or a reflection of the light beam to form a plurality of recording pixels, wherein shapes of said plurality of recording pixels are set to parallelograms of which alignments are determined in such a way that a part of recording loci of one of said plurality of recording pixels and another part of recording loci of another one of said plurality of recording pixels are subjected to a scanning, said one of said plurality of recording pixels being located adjacent to said another one of said plurality of recording pixels.

A recording method of recording in this invention provides with an image onto a recording medium by a light beam that passes through optical shutters by fixing the recording medium onto a recording medium fixing member, causing the recording medium fixing member by a recording medium fixing member moving device to move in a moving direction of the recording medium being set as a main scanning direction, emitting a light beam, that expands one-dimensionally, from a light source to the recording medium fixing member, and arranging an optical shutter device, that is constructed by aligning a large number of optical shutters at least one-dimensionally, between the light source and the recording medium fixing member to control a passing or a reflection of the light beam, wherein pixel shapes of respective optical shutters are formed as almost rectangles and, if an angle between a line D connecting an upper right portion A of an n-th pixel and a lower left portion B of an n+1-th pixel and a line E connecting the lower left portion B of the n+1-th pixel and an upper left portion C of the n+1-th pixel is set as θ1 and an angle between a one-dimensionally aligned direction of the optical shutters inclined to the main scanning direction and a sub-scanning direction is set as θ2, $$\theta 1 \leqq \theta 2$$

is satisfied.

A recording method of recording in this invention provides with an image onto a recording medium by a light beam that passes through optical shutters by fixing the recording medium onto a recording medium fixing member, causing the recording medium fixing member by a recording medium fixing member moving device to move in a moving direction of the recording medium being set as a main scanning direction, emitting a light beam, that expands one-dimensionally, from a light source to the recording medium fixing member, and arranging an optical shutter device, that is constructed by aligning a large number of optical shutters at least one-dimensionally, between the light source and the recording medium fixing member to control a passing or a reflection of the light beam, wherein pixel shapes of respective optical shutters are formed as parallelograms and an optical shutter device, in which clearances are formed between recording loci of parallelogram pixels formed by neighboring optical shutters in a sub-scanning direction, is arranged to rotate such that an angle θ3 between a line connecting an acute angle portion H on a right side of an n-th pixel and an acute angle portion J on a left side of an n+1-th pixel and a sub-scanning direction axis is set to 90 degree or more.

A recording method in this invention, the recording medium is formed of heat-mode sensitive material that is constructed by laminating a toner layer of a transfer sheet and an image receiving layer of an image receiving sheet.

A recording method in this invention, heat-mode sensitive material that is constructed by laminating a toner layer of a transfer sheet and an image receiving layer of an image receiving sheet is employed as the recording medium.

DESCRIPTION OF THE PREFERRED EMBODIMENTS

Figure 1:
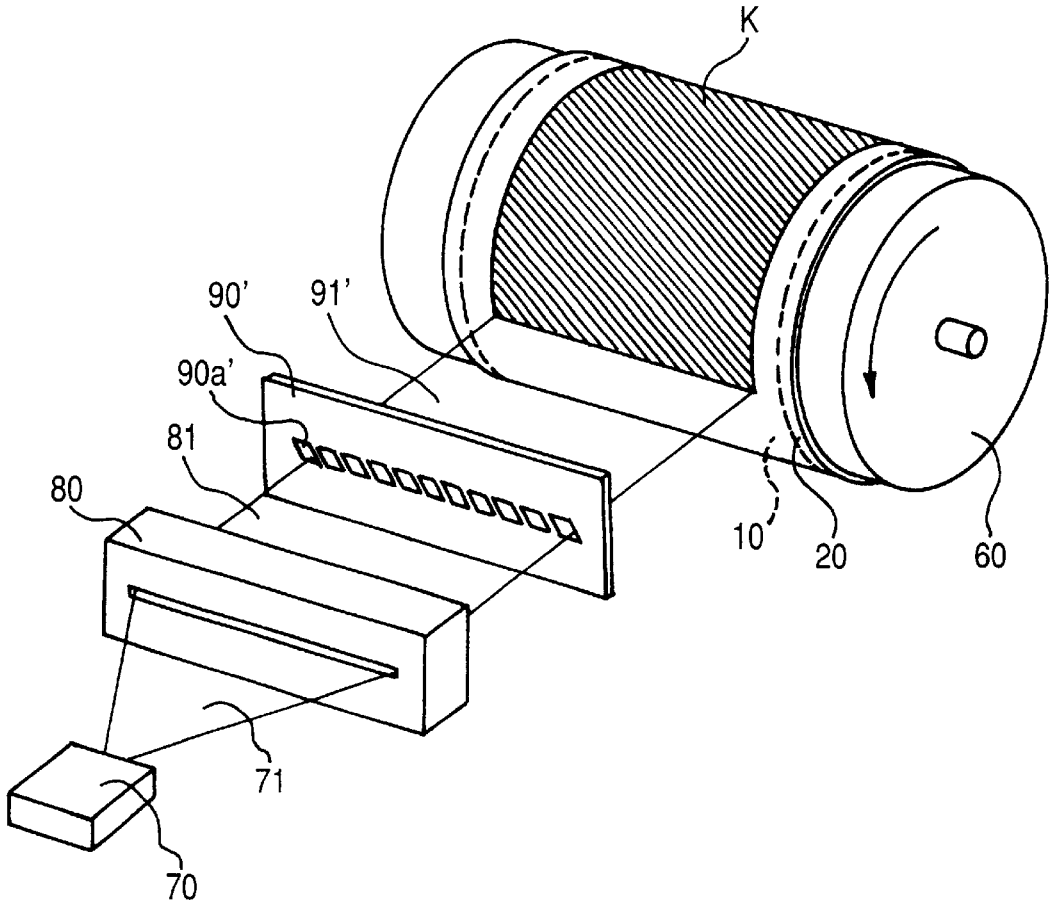
FIG. 1 shows a view showing an example of a configuration of a recording apparatus according to a first embodiment of the present invention.
Figure 2A:
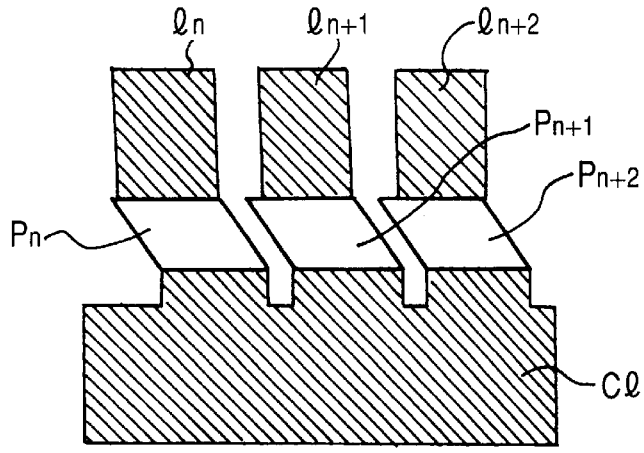
FIGS. 2(*a*)–2(*d*) show descriptive views showing optical shutters employed in the recording apparatus in FIG. 1.
Figure 2B:
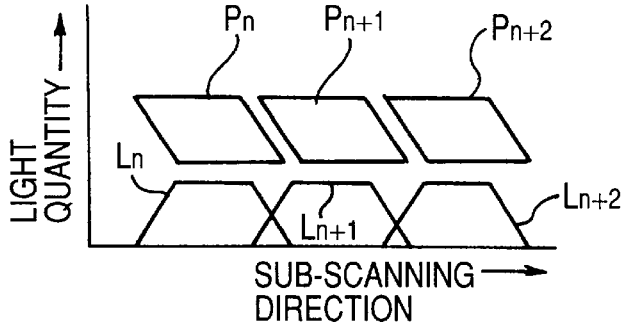
Figure 2C:
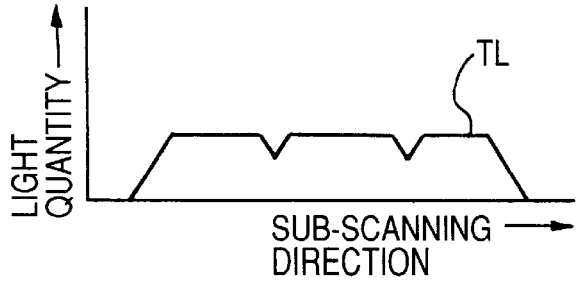
Figure 2D:
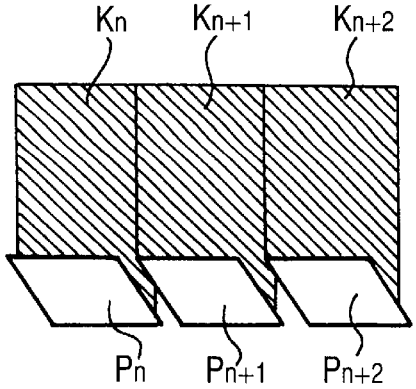

First, an example of a recording apparatus that is treated as an object by the present invention will be explained with reference to FIG. 1 hereunder. In FIG. 1, 70 is the light source, and normally the laser light source, the light emitting diode, or the like is employed.

Preferably, the semiconductor laser diode, the solid state laser, and the gas laser, that emits the near infrared ray, can be employed. Normally the wavelength of these light sources of 780 to 1100 nm is employed. In particular, the semiconductor laser diode that is small in size is usually employed, and its wavelength is 800 to 900 nm.

Also, followings can be employed as the light source 70 in answer to the wavelength sensitivity of the recording medium.

I. the semiconductor laser diode having the wavelength of about 650 nm,

II. the combination laser of the YAG laser having the wavelength of about 532 nm and SHG, III. the semiconductor laser diode having the wavelength of about 405 nm, IV. the combination laser of the YAG laser having the wavelength of about 355 nm and SHG,
the combination laser of the YLF laser and SHG, V. the combination laser of the YAG laser having the wavelength of about 266 nm and SHG, VI. the excimer laser having the wavelength of about 248 nm, and VII. the excimer laser having the wavelength of about 193 nm.

The one-dimensional converting means 80 converts the point light source emission 71 from the light source 70 into the one-dimensional collimated light 81, and the lens, or the like. In addition, 90' is an optical shutter device that controls the ON/OFF modulation of the collimated light 81 emitted from the one-dimensional converting means 80. In FIG. 1, a set of optical shutters 90*a*' are aligned linearly in the lateral direction. Also, the recording drum 60 is provided. The recording medium (the image receiving sheet 10 and the transfer sheet 20) is sucked by the recording drum sucking means, or the like described later, and fixed onto the recording drum 60. This recording drum 60 is rotated in the direction indicated by the arrow (main scanning direction), for example. In FIG. 1, in order to make it readily understand, the optical shutter device 90' is depicted to expand fully along the axis direction of the recording drum 60. But actually the width in the axis direction is smaller and also the optical shutter device 90 side is constructed such that it can be moved in the direction perpendicular to the main scanning direction.

Therefore, this recording apparatus is constructed such that, while irradiating the transmitted light onto the recording medium, that is fitted to the recording drum 60 and consists of the image receiving sheet 10 and the transfer sheet 20, by ON(pass)/OFF(cutoff)-controlling the recording laser light, that is emitted from the laser head 70 having the laser light source, by virtue of the optical shutter device 90', the laser head 70, the one-dimensional converting means 80, and the optical shutter device 90' are moved in parallel with the axis direction of the recording drum 60 while rotating the recording drum 60 in the direction indicated by the arrow, so that two-dimensional images can be formed on the recording medium.

Figure 8:
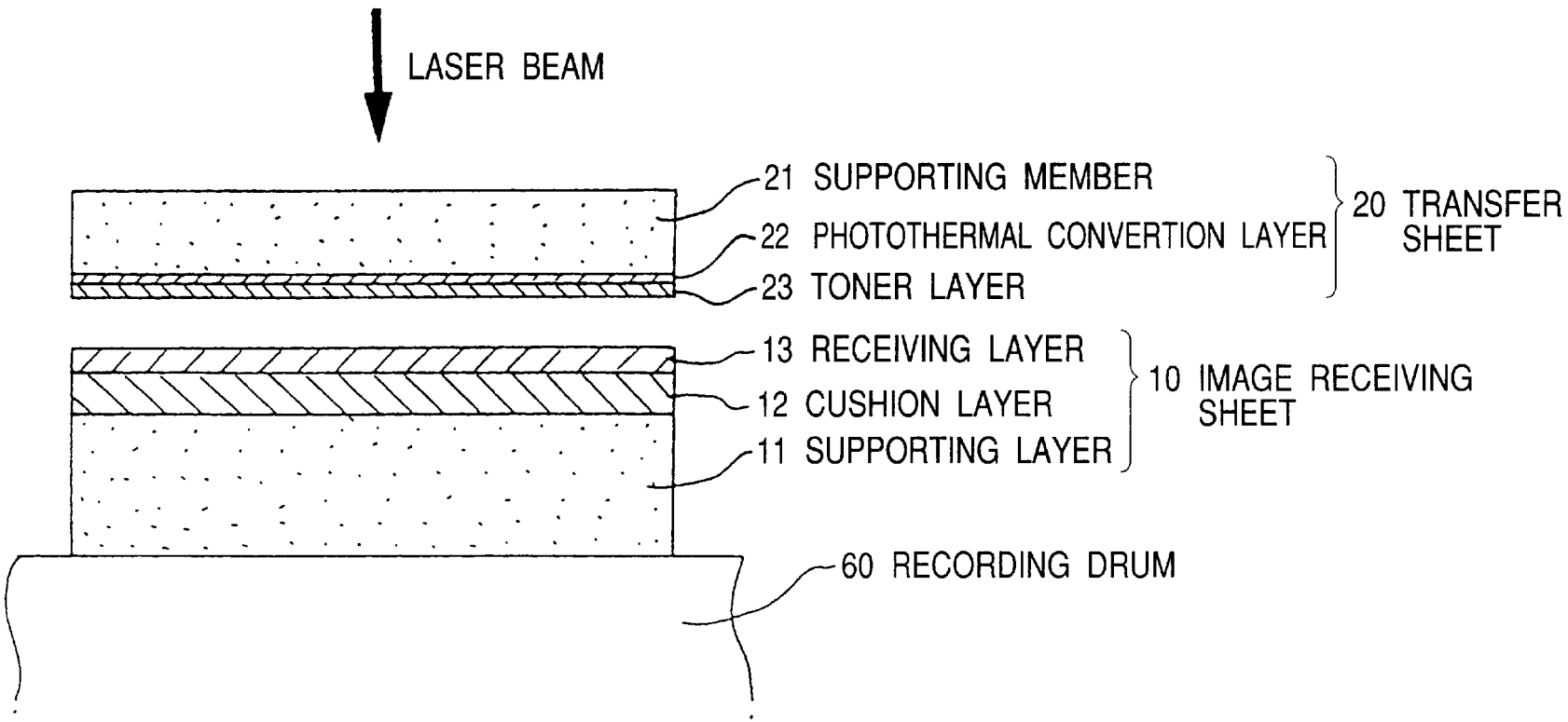
FIG. 8 shows a view showing a configuration of the image receiving sheet and the transfer sheet loaded on a recording drum.

Then, configurations of the image receiving sheet 10 and the transfer sheet 20 loaded on the recording drum 60 will be explained with reference to FIG. 8. The image receiving sheet 10 is composed of a supporting member 11, a cushion layer 12, and an image receiving layer 13 in sequence from the recording drum 60 side. Also, the transfer sheet 20 for covering the image receiving sheet 10 is composed of a supporting member 21, a photothermal conversion (IR) layer 22, and a toner layer 23 in sequence from the laser light irradiating side.

This image receiving sheet 10 is fitted to the recording drum 60, the transfer sheet 20 is superposed onto the image receiving sheet 10 such that the toner layer is directed to the image receiving sheet 10 side. Thus, when the laser light is irradiated to the transfer sheet 20 from the opposite side of the image receiving sheet 10 side, such laser light can transmit through the supporting member 21 since such member is transparent, whereby the irradiated portion of the toner layer 23 is transferred onto the image receiving layer 13 by the heat.

Here, the substance that can transmit the laser light, e.g., PET (polyethylene terephthalate) base, TAC (triacetylcellulose) base, PEN (polyethylene naphthalate) base, etc. may be employed as the supporting body. Also, the substance that can convert the laser energy into the heat effectively, e.g., carbon, black substance, infrared absorption pigment, specific wavelength absorption material, etc. may be employed as the photothermal conversion layer. The transfer sheets of respective colors of KCMY are contained in the toner layer. Sometimes the transfer sheets of gold, silver, brown, gray, orange, green, etc. may be employed. The image receiving layer receives the transferred toner. In addition, the cushion layer has actions to absorb a level-difference caused when the toner is laminated in plural stages and absorb a level-difference caused by the dust.

More detailed contents of the image receiving sheet 10 and the transfer sheet 20 as the recording medium employed in the recording apparatus are set forth in Patent Application Publication (KOKAI) Hei 4-296594, Patent Application Publication (KOKAI) Hei 4-327982, Patent Application Publication (KOKAI) Hei 4-327983, etc. filed by the applicant of this application, and also the recording apparatus employing such recording medium is described in detail in Patent Application Publication (KOKAI) Hei 11-277831. Therefore, please see them as occasion demands.

Also, the double-layered sheet structure consisting of the image receiving sheet 10 and the transfer sheet 20 is shown in the above, but the mono-sheet structure described later in FIG. 12 may be employed.

Also, the double-layered sheet structure consisting of the image receiving sheet 10 and the transfer sheet 20 is shown in the above, but the present invention is not limited to this. The transfer sheet 20 may be directly loaded on the recording drum 60 by providing the function of the image receiving sheet to the recording drum 60 itself.

In addition, if the recording medium has the image receiving function and the transferring function, such recording medium is not always formed like the sheet and the thick medium may be employed.

Figure 9:
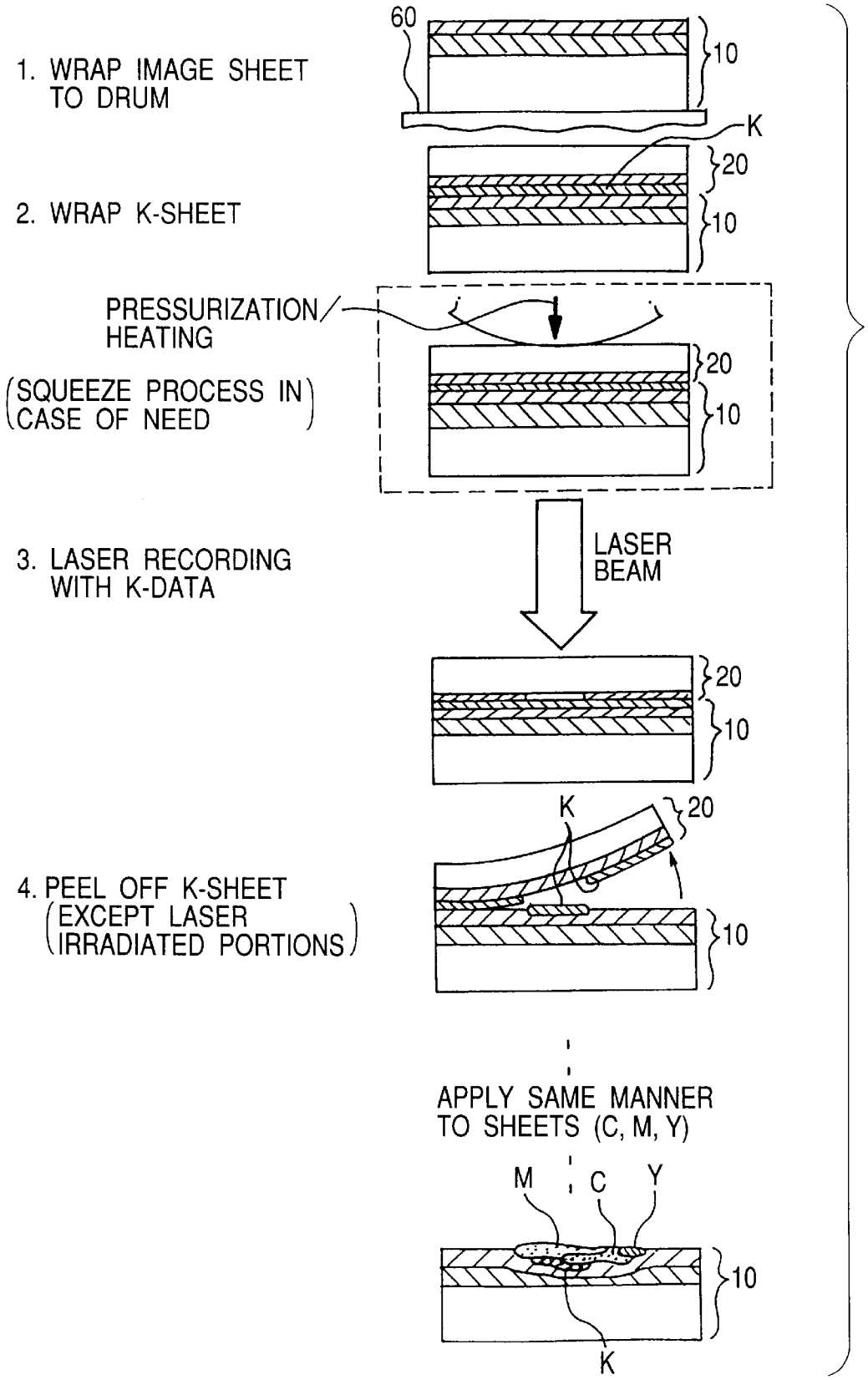
FIG. 9 shows a view showing a recording step of executing the laser-recording by employing the image receiving sheet and respective transfer sheets of KCMY, both having the structure in FIG. 8, and a peeling step after the recording.

Next, the laser recording step of executing the laser-recording by employing the image receiving sheet 10 and the transfer sheets 20 having the structure in FIG. 8 the peeling step of peeling off respective transfer sheets 20 from the image receiving sheet 10 after the recording will be explained with reference to FIG. 9.

1) Wrap the image receiving sheet 10 onto the recording drum 60.

2) First, in execute the K step, wrap the K-transfer sheet 20 on the image receiving sheet 10.

3) Execute the squeeze process as occasion demands (the adhesiveness between the image receiving sheet 10 and the K-transfer sheet 20 is enhanced by the slight pressurization/heating).

4) Irradiate the laser light based on the image/character data to execute the recording.

5) Then, when the K-transfer sheet 20 is peeled off from the image receiving sheet 10, only the K portion onto which the laser light is irradiated is transferred to the image receiving layer of the image receiving sheet 10, but other K portion onto which the laser light is not irradiated is peeled off while sticking to the K-transfer sheet 20 (the K step is ended).

6) Although not depicted in drawings, the same steps are applied in the C step and followings. That is, wrap the C-transfer sheet onto the image receiving sheet 10.

7) Execute the laser recording based on C-data.

8) Peel off the C-transfer sheet 20 from the image receiving sheet 10 (The C step is ended).

9) Then, execute the M-step. That is, wrap the M-transfer sheet 20 onto the image receiving sheet 10.

10) Execute the laser recording based on M-data.

11) Peel off the M-transfer sheet 20 from the image receiving sheet 10 (The M step is ended).

12) Then, execute the Y step. That is, wrap the Y-transfer sheet 20 onto the image receiving sheet 10.

13) Execute the laser recording based on Y-data.

14) Finally, peel off the Y-transfer sheet 20 from the image receiving sheet 10 (The Y step is ended).

15) In this manner, four colors of KCMY are laminated appropriately on the image receiving sheet 10 or not laminated to form the image, and thus the desired color image can be formed.

Then, this is transferred on the present paper.

Figure 10A:
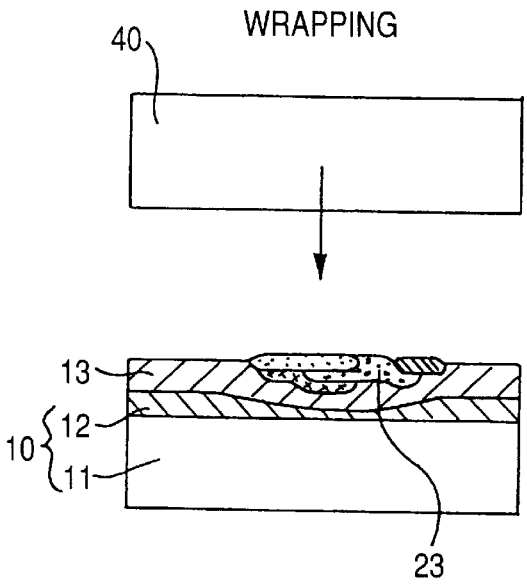
FIGS. 10(*a*)–10(*c*) show the steps of transferring four KCMY colors on the image receiving sheet onto the present paper in the prior art.
Figure 10B:
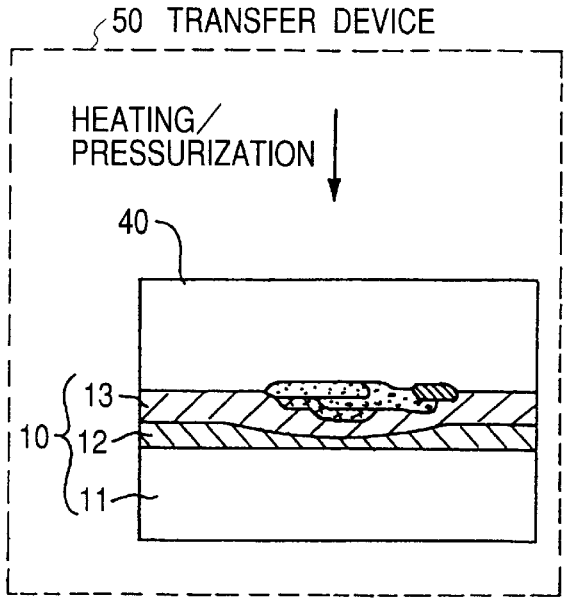
Figure 10C:
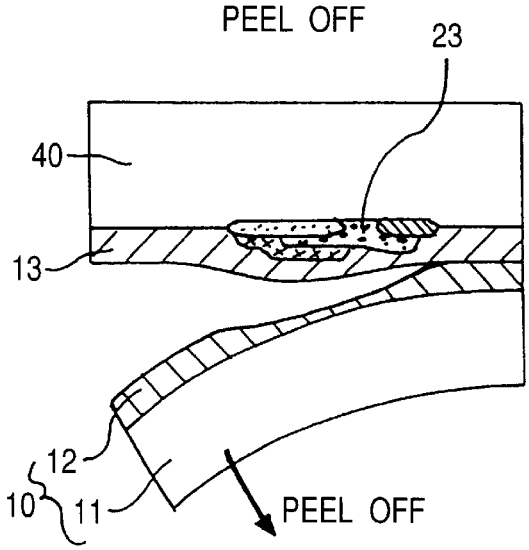

1) FIG. 10 is a view showing the step of transferring four colors of KCMY on the image receiving sheet 10 obtained by the steps in FIG. 16 onto the present paper in the prior art. In FIG. 10(*a*), four colors of KCMY are laminated appropriately on the image receiving layer 13 of the image receiving sheet 10 via the cushion layer 12 on the supporting member 11. The present paper 40 is superposed on this.

2) The overlapped sheet is passed through between two heat rollers (or the heat roller and the normal roller) in the overlapped state (FIG. 10(*b*)).

3) Then, if the image receiving sheet 10 is peeled off from the present sheet 40, both are released mutually at the cushion layer 12 of the image receiving sheet 10 as the boundary. Thus, respective colors of KCMY wrapped by the image receiving layer 13 are transferred onto the present paper side and then the predetermined colors are exhibited. The image receiving sheet 10 side being peeled off is subjected to the disposal process (FIG. 10(*c*)).

Figure 11:
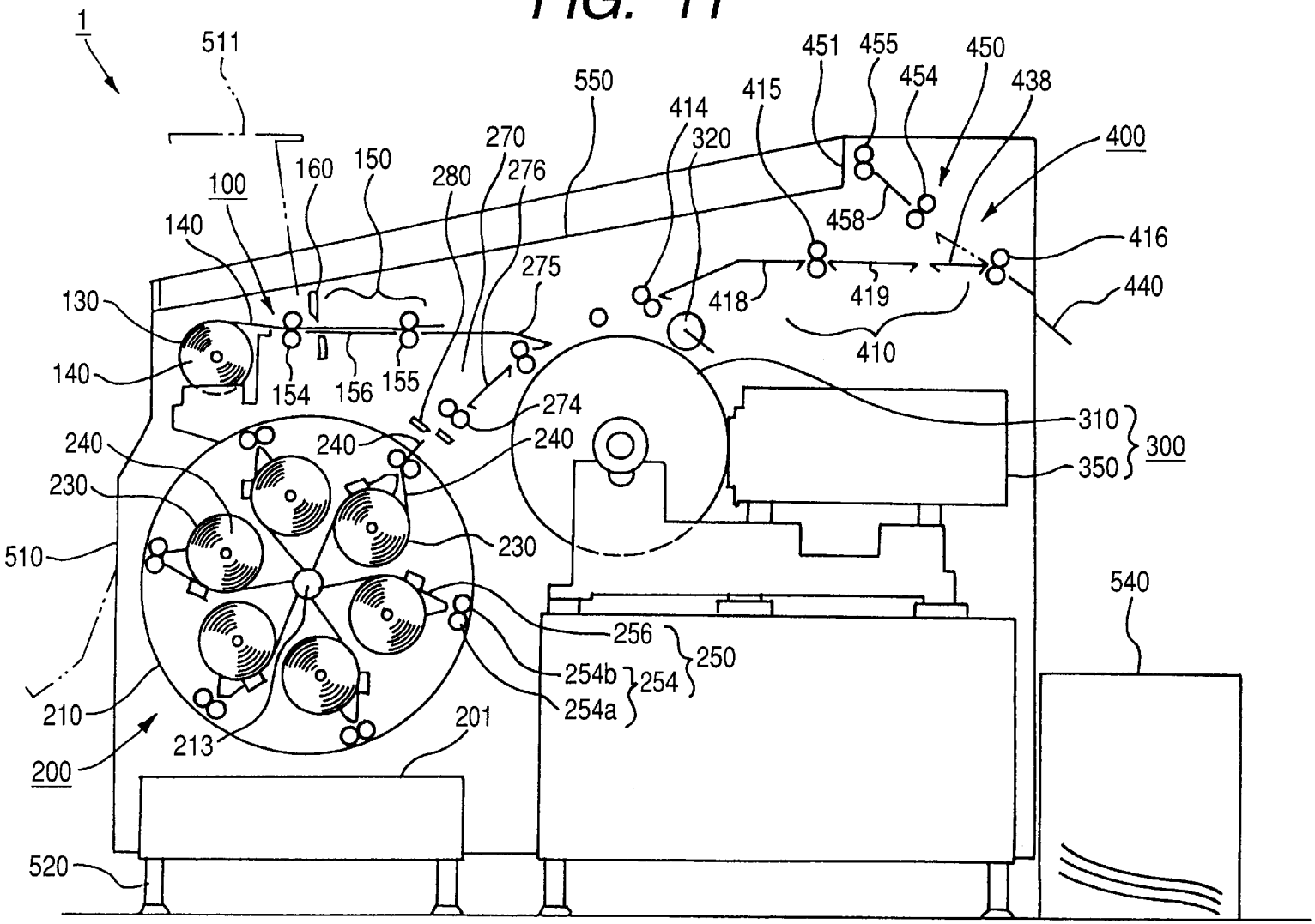
FIG. 11 shows a longitudinal sectional view showing an outline of the recording apparatus that embodies the recording method.

FIG. 11 is a longitudinal sectional view showing an outline of the recording apparatus that embodies the recording method. As shown in FIG. 11, the recording apparatus 1 comprises an image receiving sheet supplying portion 100, a transfer sheet supplying portion 200, a recording portion 300, and a discharging portion 400. Also, a surface of the recording apparatus 1 is covered with a main body cover 510 and is supported by leg portions 520.

In the recording apparatus 1, the image receiving sheet supplying portion 100 supplies the image receiving sheet to the recording portion 300. Also, the transfer sheet supplying portion 200 can supply plural type transfer sheets, and can supply selectively one type transfer sheet among the plural type transfer sheets to the recording portion 300. In the recording portion 300, the transfer sheet is wrapped onto the image receiving sheet wounded on the drum 310 to overlap with it. Then, the laser exposure is applied to the transfer sheets superposed on the image receiving sheet based on the image information to be recorded. Since the toner on the portion, heated by the laser exposure, of the transfer sheet is adhered onto the image receiving sheet due to the degradation of the adhesive property, the melting, or the sublimation to be transferred onto it, the image is formed on the image receiving sheet. In addition, if the toners on the transfer sheets having plural different colors (for example, black, yellow, cyanogens, magenta) are adhered to the same image receiving sheet, the color image can be formed on the image receiving sheet. As described later, this can be achieved by the laser exposure executed after the exposed transfer sheet is exchanged into another color transfer sheet sequentially, while wrapping the image receiving sheet onto the drum 310 as it is.

The image receiving sheet on which this image is formed is discharged via the discharging portion 400, and then picked up from the present recording apparatus. Then, the image receiving sheet is heated/pressurized in a separately provided image transfer portion (not shown) in the situation that its surface on which the image is formed is overlapped on the present paper as the printing object. Accordingly, the toner is transferred onto any present paper (printing sheet) and thus the image is formed.

The above is an outline of the recording apparatus 1.

Next, the image receiving sheet supplying portion 100, the transfer sheet supplying portion 200, the recording portion 300, and the discharging portion 400 will be explained in sequence respectively.

The image receiving sheet supplying portion 100 has an image receiving sheet roller 130. The image receiving sheet roller 130 is formed by wrapping an image receiving sheet 140 on its core. The image receiving sheet 140 has a supporting layer 142, an image receiving layer 144, and a cushion layer, and the cushion layer and the image receiving layer 144 are laminated sequentially on the supporting layer 142. In the image receiving sheet roller 130, the image receiving layer is wrapped on the outside of the supporting layer (the image receiving sheet wrapped in this manner is referred to as an "externally wrapped" image receiving sheet roller hereinafter). Also, the image receiving sheet roller 130 is provided such that it can be rotated around the center axis of the core.

The image receiving sheet supplying portion 100 has further an image receiving sheet carrying portion 150. The image receiving sheet carrying portion 150 comprises a motor (not shown), a drive transmitting belt or chain (not shown), carrying rollers 154, 155, a supporting guide 156, an image receiving sheet cutting portion 160, and a sensor (not shown) for sensing end points of the image receiving sheet.

The carrying rollers 154 and the carrying rollers 155 have a pair of rollers respectively. According to such driving mechanism, the image receiving sheet 140 can be sent out to the recording portion 300 or be returned from the recording portion 300.

First, the image receiving sheet 140 is pulled out by the above-mentioned driving mechanism such as the motor in the situation that a top end portion of the image receiving sheet roller 130 is put between the carrying rollers 154. Accordingly, the image receiving sheet roller 130 is turned and also the image receiving sheet 140 is fed out. The image receiving sheet 140 is sandwiched by the carrying rollers 155 and then guided by the supporting guide 156 to carry.

In this manner, the image receiving sheet 140 carried by the image receiving sheet carrying portion 150 is cut out by the image receiving sheet carrying portion 150 to have a predetermined length. A sensor is employed to measure the length. The length can be measured by sensing the top end of the image receiving sheet 140 by virtue of the sensor with regard to the rotation number of the motor, etc. The image receiving sheet 140 is cut at a predetermined length based on this measured result, and then supplied to the recording portion 300. The image receiving sheet cutting portion 160 has a cutter, a supporting portion, and a guide, although they are not shown. The carrying of the image receiving sheet 140 fed out from the image receiving sheet roller 130 by the above driving is stopped based on the measured result of the above image receiving sheet length, and then is cut by the cutter to have a predetermined length.

As described above, the image receiving sheet supplying portion 100 can supply the image receiving sheet 140 having a predetermined length to the recording portion 300 by feeding a part of the image receiving sheet roller 130 and then cutting the image receiving sheet.

Next, the transfer sheet supplying portion 200 will be explained hereunder.

The transfer sheet supplying portion 200 has a carrousel 210. As described later, this carrousel 210 is rotated around a rotating axis 213. Also, a plurality (six in FIG. 11) of transfer sheet rollers 230 are installed in the carrousel 210 and are arranged in a "radial fashion" around the rotating axis 213.

Each transfer sheet roller 230 has a core, transfer sheets 240 wrapped on the core, and flanges (not shown) which are inserted from both sides of the core. Each transfer sheet roller 230 is held rotatably around the core. Since an outer diameter of the flanges is set larger than a diameter of the transfer sheet portion, collapse of such transfer sheet portion can be prevented.

Each transfer sheet 240 has a supporting layer, a photothermal conversion layer, and a toner layer. The photothermal conversion layer and the toner layer are laminated in sequence on the supporting layer. In the transfer sheet roller 230, the toner layer is wrapped on the outside of the supporting layer (the transfer sheet roller wrapped in this manner is referred to as an "externally wrapped" transfer sheet roller hereinafter). As described later, the toner layer has toner ink, and this toner ink is transferred onto the image receiving sheet by the laser exposure.

In FIG. 11, the case where six transfer sheet rollers 230 are installed in the carrousel 210 is shown. As this six type transfer sheets, for example, four color transfer sheets of black (K), cyanogens (C), magenta (M), yellow (Y) and special two color transfer sheets (for example, gold, silver, etc.) may be employed.

The carrousel 210 has transfer sheet feeding mechanisms 250 to respond to a plurality of transfer sheet rollers 230 respectively. The transfer sheet feeding mechanism 250 consists of a feed roller 254 and a supporting guide 256. In FIG. 11, six transfer sheet feeding mechanisms 250 are provided. The feed rollers 254 have a pair of rollers 254*a*, 254*b*. As described later, the roller 254*a* is connected to a motor by a gear mechanism and driven by the motor. The rollers 254*a*, 254*b* can put the transfer sheet 240 between them by a predetermined pressure. Then, the roller 254*b* rotates in the reverse direction to the roller 254*a* to carry the transfer sheet 240. The transfer sheet 240 can be held and fed out by the rollers 254*a*, 254*b* or can be returned oppositely by the rollers 254*a*, 254*b*. Also, the transfer sheet roller 230 is rotated according to the carry of the transfer sheet 240.

The transfer sheet 240 is supplied to the recording portion 300 by the transfer sheet feeding mechanisms 250 having such structure. The feed rollers 254 are driven by the above-mentioned driving mechanism such as the motor in the situation that a top end of the transfer sheet 240 is put between the feed rollers 254. The transfer sheet 240 is fed out by this driving. Also, the transfer sheet 240 is cut in a transfer sheet carrying portion 270, described later, to have a predetermined length and then supplied to the recording portion 300.

As described above, the carrousel 210 that installs a plurality of transfer sheet rollers 230 therein can supply selectively the desired type transfer sheet 240 to the transfer sheet carrying portion 270.

Also, the transfer sheet supplying portion 200 has the transfer sheet carrying portion 270. The transfer sheet carrying portion 270 comprises a motor (not shown), a drive transmitting belt or chain (not shown), carrying rollers 274, 275, a guide 276, a transfer sheet cutting portion 280, and a sensor (not shown) for sensing an end of the transfer sheet. The carrying rollers 274, 275 have a pair of rollers respectively. The rollers 274, 275 are connected to the motor via the drive transmitting belt or chain and driven by the motor to carry the transfer sheet 240. According to such driving mechanism, the transfer sheet 240 can be fed out to the recording portion 300 or can be returned oppositely.

Also, the transfer sheet 240 carried in this manner is cut by the transfer sheet cutting portion 280 to have a predetermined length. A sensor is utilized to measure the length of the transfer sheet 240. The length can be measured by sensing the end of the transfer sheet 240 by the sensor with regard to the revolution number of the motor, etc. The transfer sheet 240 is cut based on the measured result at a predetermined length and then supplied to the recording portion. Although not shown, the transfer sheet cutting portion 280 has a cutter, a supporting portion, a guide, etc.

As described above, the transfer sheet supplying portion 200 can supply the transfer sheet 240 having the predetermined length to the recording portion 300 by feeding out a part of the transfer sheet roller 230 and then cutting the transfer sheet.

When the transfer sheet 240 is exhausted, the used transfer sheet roller 230 must be detached and the transfer sheet 240 must be exchanged with the new transfer sheet 240.

The exchange of the transfer sheet roller 230 can be done by opening a lid 511. At this time, the transfer sheet roller 230 as the exchanged object is shifted previously to a predetermined exchanging position corresponding to the lid 511 by turning the carrousel 210. Also, the exchange of the image receiving sheet roller 130 is conducted by opening the lid 511.

Next, the recording portion 300 will be explained hereunder.

The recording portion 300 has a drum 310. The drum 310 has a hollow cylindrical shape, and is held rotatably by a frame (not shown). The drum 310 is coupled to a rotating axis of a motor and is rotated/driven by the motor. A plurality of hole portions are formed on a surface of the drum 310. These hole portions are connected to a sucking apparatus (not shown) such as a blower, a vacuum pump, etc.

If the above image receiving sheet 140 and the transfer sheet 240 are loaded on the drum 310 and then the sucking apparatus is operated, these sheets are sucked onto the drum 310.

Also, the drum 310 has a plurality of groove portions (not shown). The plurality of groove portions are provided on a straight line in parallel with the rotating axis of the drum 310.

Also, in order to enhance the adhesiveness between the image receiving sheet 140 and the transfer sheet 240, the overlapped portion between the image receiving sheet 140 and the transfer sheet 240 is slightly heated/pressed (squeeze process) by a heating/pressurizing roller 320 as the case may be. Also, a plurality of peeling claws (not shown) are provided over the drum 310 on a straight line in parallel with the rotating axis of the drum 310.

In addition, the recording portion has a recording head 350. The recording head 350 can be constructed by a light source for emit the laser light, a one-dimensional converting means for converting this laser light into the one-dimensional collimated light, and an optical shutter device for controlling ON/OFF modulation of the collimated light emitted from the one-dimensional converting means. The toner ink on the transfer sheet 240 at the position to which the laser light passed through this optical shutter device is irradiated is transferred onto the surface of the image receiving sheet 140. Also, the recording head 350 can be moved linearly by a driving mechanism (not shown) in the direction in parallel with the rotating axis of the drum 310. Accordingly, the desired position on the transfer sheet for covering the image receiving sheet can be laser-exposed by a combination of the rotation motion of the drum 310 and the linear motion of the recording head 350. As a result, if only the corresponding position is laser-exposed based on the image information by scanning the transfer sheet by the laser light serving as the drawing light beam, the desired image can be transferred onto the image receiving sheet 140.

Next, a wrapping operation of the image receiving sheet 140 and the transfer sheet 240 onto the drum 310 will be explained hereunder.

Two type sheets of the image receiving sheet 140 and the transfer sheet 240 are wrapped onto the drum 310. First, the image receiving sheet 140 supplied by the image receiving sheet supplying portion 100 is wrapped onto the drum 310. As described above, a plurality of hole portions 314 are formed on the surface of the drum 310 and the image receiving sheet 140 is sucked by the sucking apparatus. Therefore, the image receiving sheet 140 is wrapped on the drum 310 with the rotation of the drum 310 while being sucked by the drum 310.

Then, a sheet of transfer sheet 240 supplied from the transfer sheet supplying portion 200 is wrapped on the image receiving sheet 140. Two type sheets of the image receiving sheet 140 and the transfer sheet 240 have different sizes mutually, and the transfer sheet 240 is larger than the image receiving sheet 140 in both the longitudinal direction and the lateral direction. Accordingly, the portion of the transfer sheet 240 larger than the image receiving sheet 140 is sucked by the drum 310. The transfer sheet 240 is wrapped on the drum 310 with the rotation of the drum 310 while being sucked by the drum 310. The image receiving sheet 140 and the transfer sheet 240 are wrapped onto the drum 310 such that the toner layer of the transfer sheet 240 exists on the image receiving layer to come into contact with the image receiving layer. As described above, the toner ink of the toner layer having such positional relationship is laser-expose by the recording head 350 and is transferred onto the image receiving sheet 140. The transfer sheet 240 whose transferring operation is completed is released from the drum 310.

Next, this releasing operation will be explained hereunder.

First, the drum 310 is rotated up to a predetermined position. Then, the position of the top end portion of the above releasing claw is moved from the standby position, that does not come into contact with the drum 310, to the contact position, that comes into contact with the drum 310. The top end portion of the releasing claw is caused at this motion not to contact to the transfer sheet 240. The releasing claw is moved relatively over the drum 310 in the peripheral direction along the surface of the drum 310 with the rotation of the drum 310. The top end portion of the releasing claw is moved relatively on the surface of the drum along the shapes of the groove portions to slip into the lower side of the transfer sheet 240. The transfer sheet 240 is moved along an upper surface of the releasing claw. The transfer sheet 240 is released from the drum 310. Then, the releasing claw is lifted in the direction to go away from the drum 310 and moved to the standby position before it comes into contact with the image receiving sheet 140. After the top end portion of the transfer sheet 240 is released, the drum 310 is continued to rotate and thus the transfer sheet 240 is then released from the drum 310 and the image receiving sheet 140. At this time, since the image receiving sheet 140 is still sucked onto the drum 310 by a suction force of the sucking apparatus, only the transfer sheet 240 can be released.

Then, the transfer sheet 240 released by the above operation is discharged to the outside of the apparatus via a discharging portion 400 described later.

Then, another color transfer sheet 240 is wrapped onto the image receiving sheet 140, that is still wrapped on the drum 310, in the procedure described above. Then, according to the above operation, the toner ink of the transfer sheet 240 is transferred onto the image receiving sheet 140 by the laser exposure and then the transfer sheet 240 is released and discharged.

The similar operation is repeated for the transfer sheets 240 of predetermined plural types. For example, if the above operation is repeated for four transfer sheets 240 of black, cyanogen, magenta, and yellow, the color image can be transferred onto the image receiving sheet 140.

Finally, in this manner, the image receiving sheet 140 on which plural type toner inks are transferred is released. The release of the image receiving sheet 140 is conducted in the similar way to the release of the transfer sheets 240. At this time, the releasing claw comes close to a plurality of groove portions to release the image receiving sheet 140 from the drum 310. Also, since the same releasing claw as that used to release the transfer sheet 240 can be utilized, the configuration can be simplified. As a result, the reliability of the apparatus can be improved.

The image receiving sheet 140 released as above is discharged to the discharging portion 400.

Next, the discharging portion 400 will be explained hereunder.

The discharging portion 400 comprises a sheet common carrying portion 410, a transfer sheet discharging portion 440, and an image receiving sheet discharging portion 450.

The sheet common carrying portion 410 includes a motor (not shown), a drive transmitting belt or chain (not shown), carrying rollers 414, 415, 416, supporting guides 418, 419, and a sensor (not shown). Also, the sheet common carrying portion 410 has a mobile guiding portion which consists of a guide plate 438 and a driving mechanism (not shown). The guide plate 438 can be moved between two positions, described later, by the driving mechanism.

The image receiving sheet discharging portion 450 has an image receiving sheet discharging port 451, rollers 454, 455, and a guide 458. The image receiving sheet 140 on which the image is transferred is discharged onto a tray 550 via the image receiving sheet discharging portion 450.

Respective carrying rollers 414, 415, 416, 454, 455 are constructed by two rollers as a set in the similar way to the above carrying rollers. If the rollers are rotated while sandwiching the image receiving sheet 140 and the transfer sheet 240 between two rollers, these sheets can be carried.

The discharging portion 400 having such mechanism executes the discharge of the image receiving sheet 140 and the discharge of the transfer sheet 240 based on following operations.

First, the discharge of the transfer sheet 240 will be explained hereunder.

The transfer sheet 240 that is subjected to the laser exposure in the recording portion 300 and becomes useless is released from the drum 310 as mentioned above. While supported by the releasing claw, the supporting guides 418, 419, and the guide plate 438, the released transfer sheet 240 can be held and fed out by the carrying rollers 414, 415, 416 to carry.

Then, the discharge of the image receiving sheet 140 will be explained hereunder.

The image receiving sheet 140 is released from the drum 310, as described above, after the toner ink is transferred on the image receiving sheet 140 and processed in the recording portion 300. While supported by the releasing claw, the supporting guides 418, 419, and the guide plate 438, the released image receiving sheet 140 can be held and fed out by the carrying rollers 414, 415, 416 to carry. The sheet common carrying portion 410 is common to the case where the transfer sheet 240 is discharged, and thus the configuration can be simplified rather than the case the carrying portions are provided to respective sheets. In this case, in the sheet common carrying portion 410, the transfer sheet 240 is carried to direct the toner layer to the lower side and the image receiving sheet 140 is carried to direct the image receiving layer to the upper side. As a result, even if the image receiving sheet 140 and the transfer sheet 240 are carried sequentially by utilizing the same carrying path, there is no chance that the image formed on the image receiving layer of the image receiving sheet 140 is contaminated.

The image receiving sheet 140 is carried by the carrying rollers 414, 415, 416 and is discharged to the outside of the apparatus. However, all the image receiving sheets 140 are not always discharged to the outside of the apparatus. In the situation that the rear end portion of the image receiving sheet 140 is located on the guide plate 438 and is held by the carrying rollers 416, the drive by the motor is stopped once, and then the image receiving sheet 140 is pulled back toward the image receiving sheet discharging port 451 by rotating the motor reversely. That is, the "switch-back" operation is performed. The drive stopping timing is decided by using the signal supplied from the sensor. The sensor detects that the rear end of the image receiving sheet 140 passes through the position of the sensor, and then stops the drive of the motor 412 at a point of time when the image receiving sheet 140 is carried to reach a predetermined position. The predetermined position signifies such a position that the rear end of the image receiving sheet 140 is located on the guide plate 438 and held by the carrying rollers 416. It can be decided based on the number of the rotation pulses of the motor from a time point when the rear end is sensed by the sensor, whether or not the image receiving sheet 140 is moved by a predetermined distance to reach this position.

A guide blade 438 of the mobile guiding portion is driven by the driving mechanism (not shown) and can be moved between a broken line/a solid line shown in FIG. 18. The guide blade 438 is moved by this driving mechanism. Then, if the motor being stopped is rotated reversely, the carrying rollers 416, 454, 455, etc. are driven in the opposite direction. The image receiving sheet 140 is pulled back by this reverse rotation. Then, while supported by the guide 458, the image receiving sheet 140 is carried by the carrying rollers 454, 455 and fed out to the tray 550. As described above, the image receiving sheet being sent out to the tray 550 is taken out from the present recording apparatus, and then additional processes are executed in the separately provided image transferring portion. As a result, the image can be printed on any printing paper.

The above operations can be controlled by a controlling portion (not shown).

The controlling portion controls the image receiving sheet supplying portion 100, the transfer sheet supplying portion 200, the recording portion 300, the discharging portion 400, and others. The controlling portion controls the driving portions having the motors in above respective portions, and particularly controls the air portions such as the sucking device, etc. and the image processing portion for processing the image data in the recording portion 300. Also, the driving portion for the transfer sheet supplying portion 200 has two driving systems, i.e., a rotation driving system for the carrousel 210 and a sheet-carry driving system for providing the transfer sheet 240 from the transfer sheet roller 230 to the drum 310. As described above, as with the motor drive in the sheet-carry driving system out of them, the motor driving driver is commonly used in a plurality of transfer sheet feeding mechanism. Thus, the driving circuit system can be simplified.

According to the above recording apparatus, the desired color image can be formed on the image receiving sheet 140. Operation procedures in the case where the color image is formed by using four colors of black, cyanogen, magenta, yellow will be explained in the following.

First, in step 1, the image receiving sheet supplying portion 100 supplies the image receiving sheet 140 to the drum 310. The image receiving sheet 140 is provided by feeding out a part of the externally wrapped image receiving sheet roller 130 and then cutting the image receiving sheet, and then wrapped on the drum 310.

Then, in step 2, the transfer sheet supplying portion 200 supplies the black transfer sheet 240 to the drum 310.

When the carrousel 210 of the transfer sheet supplying portion 200 is rotated, the black transfer sheet roller 230 is moved to the position opposing to the transfer sheet carrying portion 270. The transfer sheet 240 is provided by feeding out a part of the externally wrapped transfer sheet roller 230 and then cutting the transfer sheet, and then wrapped on the drum 310. At this time, the top end of the transfer sheet 240 fed out from the transfer sheet roller 230 is positioned near the cutter 280 on the outside of the carrousel 210. At this time, after the transfer sheet 240 is fed, the transfer sheet feeding mechanism 250 can store the top end portion of the transfer sheet roller 230 at the inner side than the outer peripheral portion of the carrousel 210 by causing the feed rollers 254 to drive in the reverse direction. However, in this case, the feed rollers 254 still hold the top end.

Then, in step 3, the image is transferred and output onto the image receiving sheet 140 based on the image data given previously. Here the given image data is color-separated into images for respective colors, and the laser exposure is performed based on the image data color-separated for respective colors. The recording head 350 irradiates the drawing light beam to the transfer sheet 240 based on the image data for respective colors after the color separation. The toner ink of the transfer sheet 240 is transferred onto the image receiving sheet 140, and then the image is formed on the image receiving sheet 140.

Then, in step 4, only the transfer sheet 240 is released from the drum 310. The transfer sheet 240 released from the drum 310 is discharged into a transfer sheet recovering box 540 via the discharging portion 400.

Then, in step 5, it is decided whether or not the transfer of all color transfer sheets 240 is completed. Then, if another type transfer sheet 240 must be supplied, the processes in above steps 2 to 4 are repeated. That is, respective operation are repeated for the transfer sheets 240 of respective cyanogen, magenta, yellow colors. As a result, the toner inks of four color transfer sheets are transferred onto a sheet of image receiving sheet 140, and then the image is formed on the image receiving sheet 140.

When the above processes are ended, it is decoded in step 5 that the laser exposure for the final transfer sheet 240 is completed.

Then, in step 6, the image receiving sheet 140 is released from the drum 310. The released image receiving sheet 140 is discharged into the tray 550 via the discharging portion 400 by the switch-back operation. As for the discharged image receiving sheet 140, the toner ink on the image receiving sheet 140 is further transferred onto any printing paper in the separately provided image transferring portion. Accordingly, the proofreading color printing is carried out.

Figure 6:
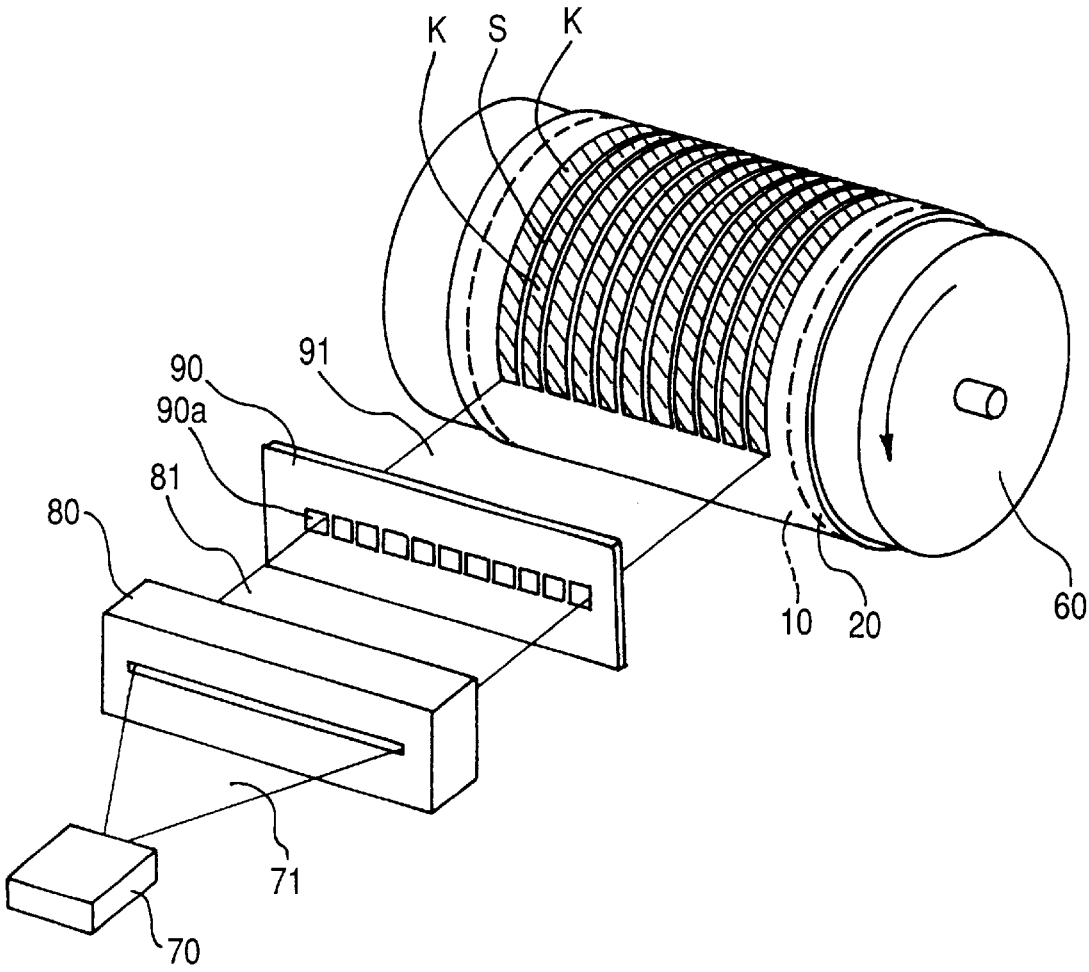
FIG. 6 shows a view showing an example of a configuration of a recording apparatus in the prior art.
Figure 7A:
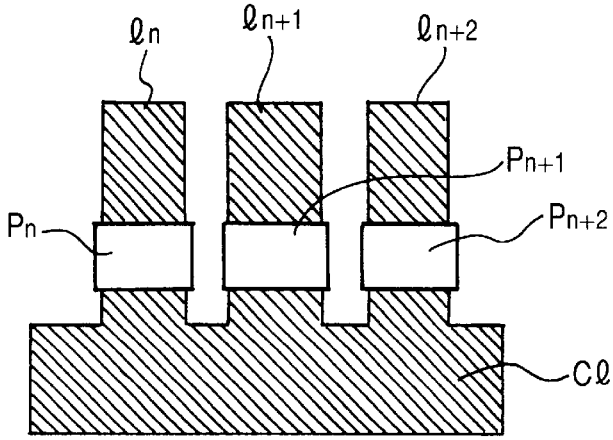
FIGS. 7(*a*)–7(*d*) show descriptive views showing the optical shutters employed in the recording apparatus in FIG. 6.
Figure 7B:
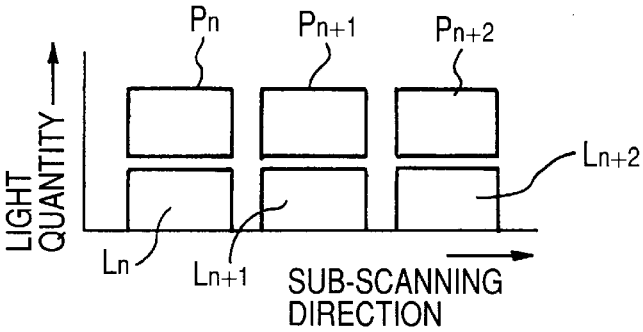
Figure 7C:
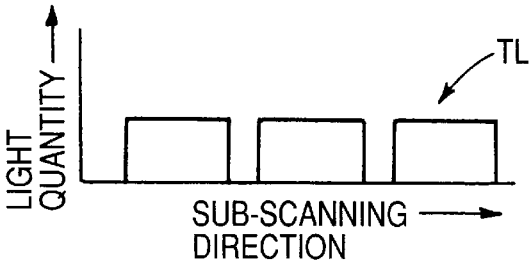
Figure 7D:
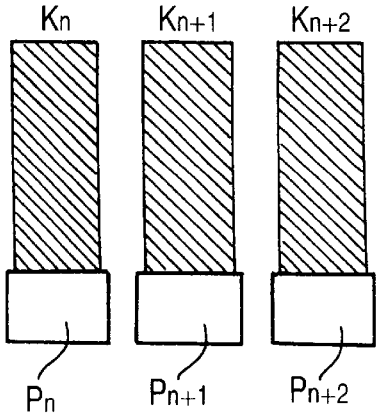

Then, returning to FIG. 1 again, in FIG. 1, the shape of the optical shutter device 90' is a feature according to a first embodiment of the present invention. That is, windows (openings) of all 10-aligned optical shutters 90*a*' of the optical shutter device 90' are shaped as a parallelogram respectively. A difference is that the shapes of the windows (openings) of the optical shutters 90*a* (FIG. 6) in the prior art are the rectangle while the shapes of the windows (openings) of the optical shutters 90*a*' herein are the parallelogram, and other configurations are similar to each other.

FIGS. 2(*a*)(*b*)(*c*)(*d*) are views showing a configuration, an optical distribution, and recording lines of three optical shutters n, n+1, n+2 out of the 10 optical shutters 90*a*' in FIG. 1.

First, the configuration and an operation of the optical shutters 90*a*' will be explained with reference to FIG. 2(*a*) hereunder.

In FIG. 2(*a*), cl is a transparent common signal line extended laterally in FIG. 2(*a*), and ln, ln+1, ln+2 are transparent selective signal lines that intersect perpendicularly with this common signal line cl (i.e., that are extended in the perpendicular direction to this sheet in this Figure respectively). Pn, Pn+1, Pn+2 are liquid crystal shutters that are provided to intersection points between the common signal line cl and the selective signal lines ln, ln+1, ln+2 respectively. Their shapes are formed as the parallelogram (only the thickness of the liquid crystal shutters is depicted in FIG. 2(*a*) if precisely depicted, but only the liquid crystal shutters are depicted in a plan view herein to make the shape easily understand). Accordingly, respective parallelogram pixels are formed. In the liquid crystal shutters Pn, Pn+1, Pn+2, the liquid crystal layer is formed by injecting and sealing the liquid crystal formed of STN (Super Twisted Nematic) liquid crystal, FLC (Ferroelectric) liquid crystal, or the like into the clearance space between the lower and upper glasses (not shown) by the known method. In this manner, patterns of the electrical signal lines are formed for respective pixels, and then the optical shutters ON/OFF (open/close)-control respective pixels independently by the selective signal lines ln, ln+1, ln+2. Then, patterns of respective signal lines are arranged not to generate the short-circuit. Also, the clearances (insulation areas) are provided between the pixels not to generate the short-circuit.

Here, the liquid crystal shutters are exemplified as the shutter. Of course, the shutters are not limited to this, and PLZT (Electro-optical effect element), micromachine, etc. may be utilized. Also, the transmissive liquid crystal is employed here, but the reflective liquid crystal may be employed.

Therefore, respective light quantities Ln, Ln+1, Ln+2 of the lights that are passed through the optical shutters Pn, Pn+1, Pn+2 when all the optical shutters Pn, Pn+1, Pn+2 are turned ON have distributions shown in FIG. 2(*b*) respectively. That is, for example, the light quantity Ln, if viewed along the sub-scanning direction, has the "trapezoid" shape that is maximum at the overlapped portion between the upper side and the lower side of the parallelogram of the optical shutter Pn and is decreased at the non-overlapped portion between the upper side and the lower side as the position goes away rightward and leftward from the overlapped portion. Similarly, the light quantity Ln+1 has also the "trapezoid" shape that is maximum at the overlapped portion between the upper side and the lower side of the parallelogram of the optical shutter Pn+1 and is decreased at the non-overlapped portion between the upper side and the lower side as the position goes away rightward and leftward from the overlapped portion. This is similarly true of the light quantity Ln+2.

For this reason, the optical shutters Pn, Pn+1, Pn+2 are arranged such that the trapezoid of the light quantity Ln, the trapezoid of the light quantity Ln+1, and the trapezoid of the light quantity Ln+2 are positioned in close vicinity to each other to overlap their inclined portions of the trapezoids mutually. Therefore, the total light quantity distribution TL that is the total distribution of respective light quantities Ln, Ln+1, Ln+2 of the lights that are passed through three optical shutters Pn, Pn+1, Pn+2 becomes almost constant, as shown in FIG. 2(*c*). Thus, the clearances between the optical shutters Pn, Pn+1, Pn+2 in the sub-scanning direction can be eliminated.

If the interval between the optical shutters Pn, Pn+1, Pn+2 cannot be arranged compactly, the inclination angle of the parallelogram may be increased.

Accordingly, if the recording is carried out by turning ON all the optical shutters Pn, Pn+1, Pn+2, respective recording lines Kn, Kn+1, Kn+2 in the main scanning direction are given as shown in FIG. 2(*d*), and thus unrecorded vertical stripes are not produced.

In this manner, according to the recording apparatus (FIG. 1) according to the first embodiment of the present invention, since no unrecorded vertical stripe is produced in the recording K in the main scanning direction when the recording is carried out by turning ON all the optical shutters 90*a*', the recording can be carried out without the image defect.

The example of the parallelogram is explained as above, but the present invention is not limited to the parallelogram optical shutters. For example, it is needless to say that, even if the parallelogram optical shutters having trapezoid windows are arranged in the sub-scanning direction by exchanging alternatively the upper bases and the lower bases of the parallelograms, the similar advantages can be achieved.

Figure 3:
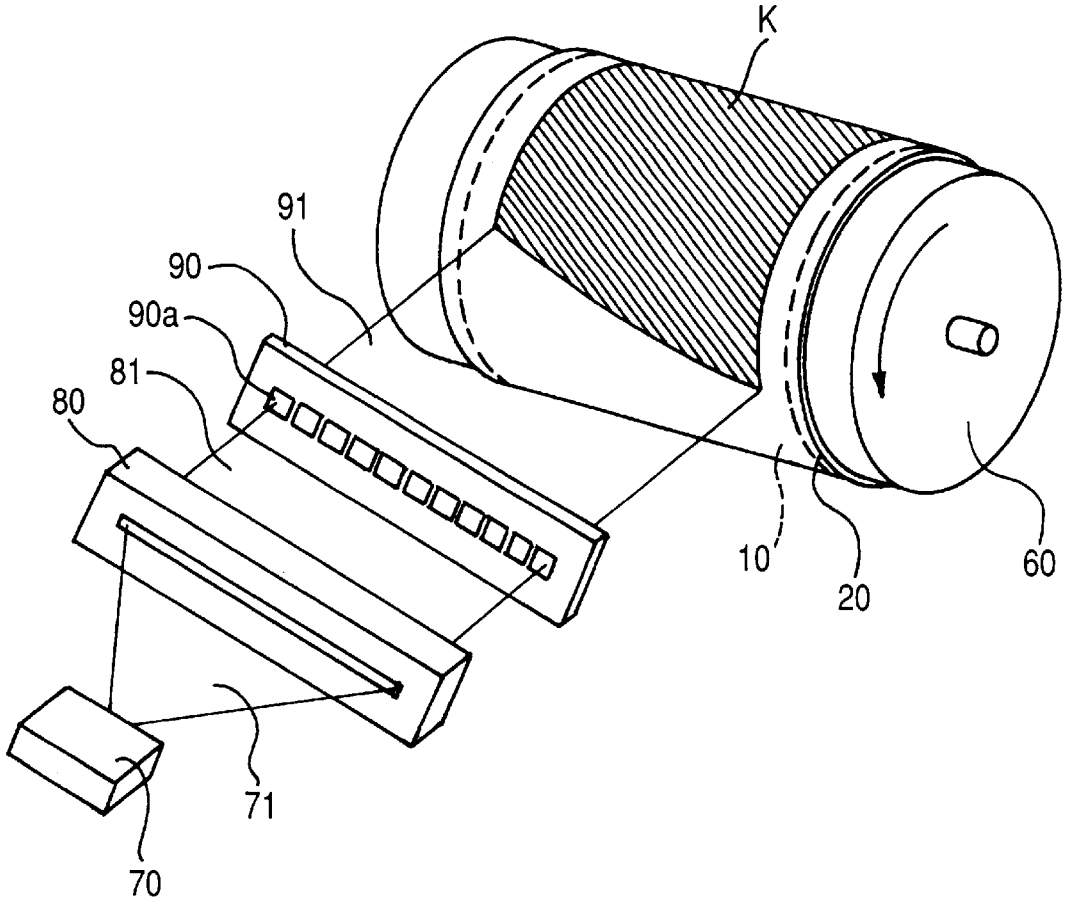
FIG. 3 shows a view showing an example of a configuration of a recording apparatus according to a second embodiment of the present invention.
Figure 4A:
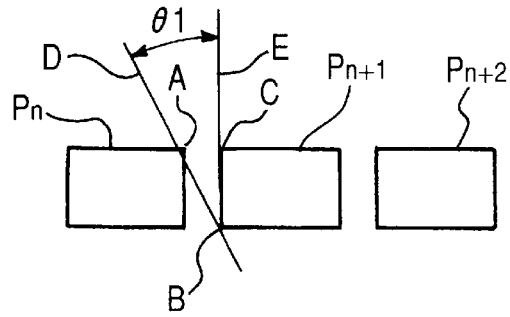
FIGS. 4(*a*)–4(*d*) show descriptive views showing optical shutters employed in the recording apparatus in FIG. 3.
Figure 4B:
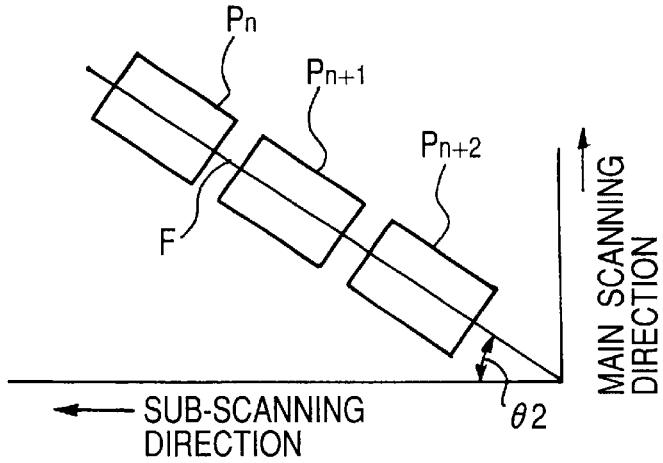
Figure 4C:
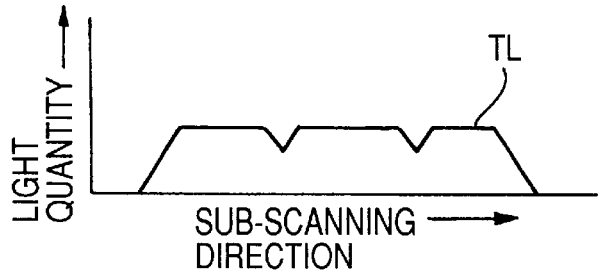
Figure 4D:
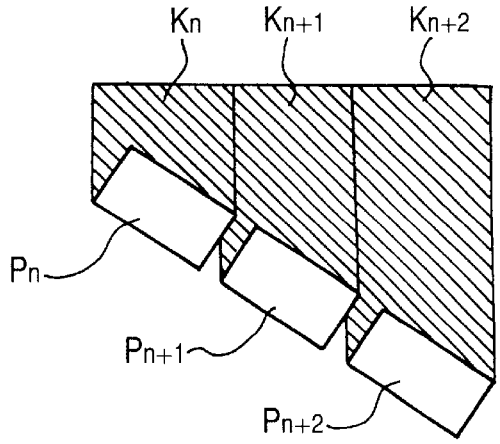

FIG. 3 shows a recording apparatus according to a second embodiment of the present invention.

The recording apparatus according to the second embodiment employs the optical shutter device 90 having the rectangular windows in the prior art. A feature of this recording apparatus is that the optical shutter device 90 is arranged to be obliquely inclined in the main scanning direction. Basically remaining portions are similar to those in FIG. 6. That is, the light is emitted from the light source 70 by applying the driving voltage to the light emitting element of the light source 70 in response to the input signal, and then the emitted light 71 from the light source 70 is irradiated into the optical shutter device 90 as the linear luminous flux 81 via the one-dimensional converting means 80. The open/close of respective optical shutters 90*a* is controlled independently in response to the input signal respectively such that the transmitted lights 91 are emitted onto the recording medium (the image receiving sheet 10 and the transfer sheet 20) on the recording drum 60, that is being rotated in the main scanning direction, with controlled light quantities at timings assigned to respective lines to form the two-dimensional images.

Since the configuration of the optical shutters 90*a* employed herein is identical to that in FIG. 7(*a*), its explanation will be omitted hereunder. FIG. 4(*a*) shows the state that three rectangular optical shutters in the apparatus that is similar to FIG. 7(*b*) in the prior art are aligned linearly. FIG. 4(*b*) shows how the optical shutters should be obliquely inclined in the main scanning direction according to the second embodiment. In FIG. 4(*b*), assume that the pixel shapes formed by respective optical shutters Pn, Pn+1, Pn+2 are the rectangle respectively, a line connecting an upper right portion A of the n-th pixel Pn and a lower left portion B of the (n+1)th pixel Pn+1 is D, a line connecting the lower left portion B and an upper left portion C of the (n+1)th pixel Pn+1 is E, and an angle between the line D and the line E is θ1. Also, assume that a one-dimensional alignment direction of the optical shutters that are inclined in the main scanning direction is F, and that an angle between F and the sub-scanning direction is θ2. In this case, it is a feature of the second embodiment that θ1≦θ2 is satisfied.

If doing this, the total light quantity distribution TL that is the total distribution of respective light quantities of the lights that are passed through three optical shutters Pn, Pn+1, Pn+2 becomes substantially constant, as shown in FIG. 4(*c*). Thus, there is no clearance between the optical shutters Pn, Pn+1, Pn+2 in the sub-scanning direction.

As a result, if the recording is carried out by turning ON all the optical shutters Pn, Pn+1, Pn+2, respective recording lines Kn, Kn+1, Kn+2 in the main scanning direction are given as shown in FIG. 4(*d*), and thus unrecorded vertical stripes are not produced.

In this case, if the optical shutters Pn, Pn+1, Pn+2 are inclined in this way, the recording pixels are shifted in the main scanning direction. Therefore, recording timings of the pixels in the main scanning direction must be delayed, but such delay is not technically difficult at all.

In this manner, according to the recording apparatus (FIG. 3) according to the second embodiment of the present invention, since no unrecorded vertical stripe is produced in the recording K in the main scanning direction when the recording is carried out by turning ON all the optical shutters 90*a*', the recording can be carried out without the image defect.

Also, since a pitch in the sub-scanning direction becomes narrow, it is also possible to achieve the advantage that the high-resolution recording can be carried out.

The example in which the rectangular optical shutters are inclined is explained as above. But the present invention is not limited to the rectangular optical shutters. For example, even if the parallelogram optical shutters between which minute clearances are produced in the sub-scanning direction in recording are employed, it is needless to say that the same advantage can be achieved by inclining these optical shutters.

Figure 5A:
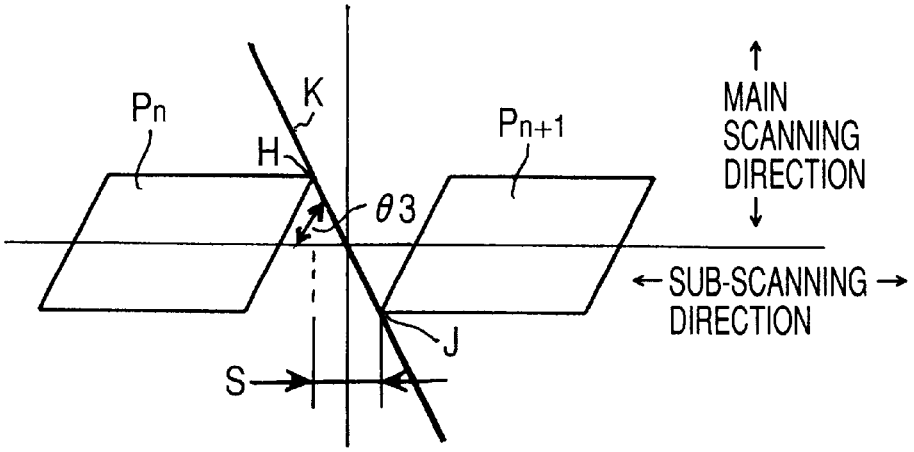
FIGS. 5(*a*)–5(*b*) show views showing an inclination of the optical shutters that have a clearance between them in the sub-scanning direction.
Figure 5B:
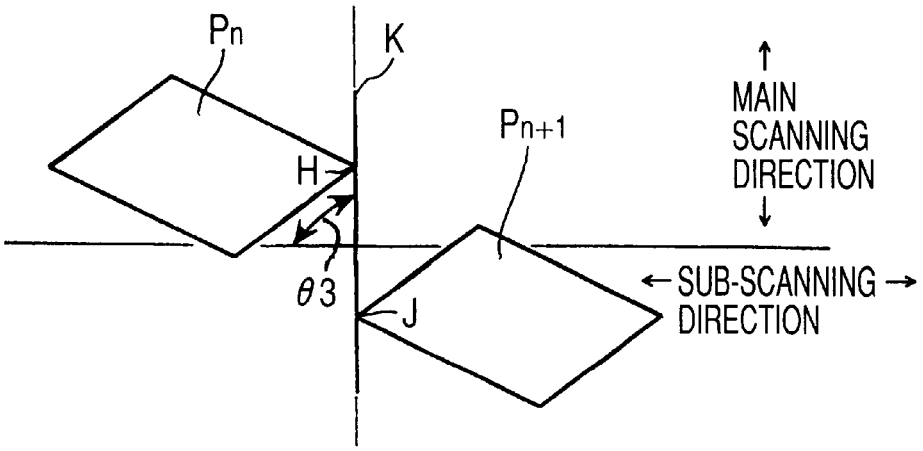

FIGS. 5(*a*)(*b*) shows these optical shutters. FIG. 5(*a*) shows the parallelogram optical shutters between which a clearance is produced in the sub-scanning direction. FIG. 5(*b*) shows the state that the parallelogram optical shutters are inclined according to the second embodiment of the present invention. In FIGS. 5(*a*)(*b*), the pixel shapes formed by the optical shutters Pn, Pn+1 are the parallelogram. It is possible to understand that, since the clearance S exits between the acute angle portion H of the optical shutter Pn and the acute angle portion J of the optical shutter Pn+1 along the sub-scanning direction, the clearance is produced in the sub-scanning direction even when the recording is carried out in the aligned state shown in FIG. 5(*a*). As a result, if the recording is carried out as it is, the image defect is generated.

Therefore, according to the second embodiment of the present invention, as shown in FIG. 5(*b*), the pixel shapes formed by respective optical shutters are the parallelogram respectively, and also the optical shutter device, by which the clearances are produced between the recording loci of the parallelogram pixels formed by the neighboring optical shutters in the sub-scanning direction, is arranged to be rotated such that an angle θ3 between a line connecting the acute angle portion H of the (n)th optical shutter Pn and the acute angle portion J of the (n+1)th optical shutter Pn+1 and the sub-scanning direction axis exceeds 90 degree. As a result, since the acute angle portion H of the optical shutter Pn and the acute angle portion J of the optical shutter Pn+1 are overlapped with each other along the sub-scanning direction, the clearance S shown in FIG. 5(*a*) is never produced in the sub-scanning direction. Thus, the stripes extended in the main scanning direction to cause the image defect are not generated in the image recording formed by the optical shutters.

The recording apparatus consisting of a combination of the light beam and the optical shutters is explained up to now as above. But the present invention is not limited to this. For example, in the recording apparatus using the thermal head, it is needless to say that the recording having no image defect can be carried out by exchanging the shapes of the pixels formed by the thermal head from the rectangle to the parallelogram.

Also, heat-mode sensitive material is employed as the recording medium of the laser irradiation in the above. But the present invention is not limited to this, photon-mode sensitive material is employed as the recording medium of the laser irradiation. As the photon-mode sensitive material, photosensitive thermal transferring material set forth in Patent Application No. Hei 11-36308 (Patent Application Publication (KOKAI) Hei 2000-199952) may be employed. In other words, the recording material used in the image recording method is the photosensitive thermal transferring material in which a photosensitive thermal recording layer is provided on the supporting body, and consists of any one of following structures (a) to (c).

(a) The photosensitive thermal transferring material having the photosensitive thermal recording layer, that contains the heat responsive microcapsules including the coloring component A therein and the photopolymerizing composition that consists of the achromic compound B and the photopolymerization initiator and is arranged on the outside of the microcapsules, on the supporting body. This achromic compound B contains polymerizing groups and portions that react with the coloring component A to generate the color in the same molecule.

(b) The photosensitive thermal transferring material having the photosensitive thermal recording layer, that contains the heat responsive microcapsules including the coloring component A therein, and the photopolymerizing composition that consists of the achromic compound C, the achromic compound D, and the photopolymerization initiator and is arranged on the outside of the microcapsules, on the supporting body. This achromic compound C reacts with the coloring component A to generate the color, and this achromic compound D contains polymerizing groups and portions that suppress the reaction between the coloring component A and the compound C in the same molecule.

(c) The photosensitive thermal transferring material having the photosensitive thermal recording layer, that contains the microcapsules and the achromic compound E arranged on the outside of the microcapsules, on the supporting body. These microcapsules include the coloring component A and the photopolymerizing composition consisting of the polymerizing compound and the photopolymerization initiator, and this achromic compound E reacts with the coloring component A to generate the color.

In the photosensitive thermal transferring material (a), when exposed in a desired image profile, the photopolymerizing composition arranged on the outside of the microcapsules produces the polymerization reaction by the radical generated from the photopolymerization initiator and is cured to form the latent image of the desired image profile. Then, the compound B existing in the unexposed portion moves in the recording material by the heating and reacts with the coloring component A in the microcapsules to generate the color. Therefore, this material (a) is the positive-type photosensitive thermal transferring material in which the exposed portion does not generate the coloring and the uncured portion of the unexposed portion generates the coloring, whereby the image is formed.

In the photosensitive thermal transferring material (b), the compound D having the polymerizing groups are polymerized by the radical generated from the reacted photopolymerization initiator by the exposure to cure the film, and thus the latent image of the desired image profile is formed. The compound C moves depending on the film characteristics of this latent image (cured portion), and reacts with the coloring component A in the microcapsules to form the image. Therefore, this material (b) is the negative-type photosensitive thermal transferring material in which the exposed portion generates the coloring, whereby the image is formed.

In the photosensitive thermal transferring material (c), when exposed in the desired image profile, the photopolymerizing compound contained in the microcapsules is polymerized by the radical generated from the photopolymerization initiator that exists in the same microcapsules and reacted by the exposure, and the insides of the microcapsules are cured, and thus the latent image of the desired image profile is formed. In other words, the coloring reaction with the compound C existing on the out side of the microcapsules is suppressed in the unexposed portion, and the compound C existing in the unexposed portion moves in the recording material by applying the pressure, and such compound C reacts with the coloring component A in the microcapsules to generate the color. Therefore, this material (c) is the positive-type photosensitive thermal transferring material in which the exposed portion does not generate the coloring and the uncured portion of the unexposed portion generates the coloring, whereby the image is formed.

Next, the recording material will be explained hereunder. As the basic structure of the recording material, those corresponding to recording materials (a) to (c) may be listed, and respective constituent components will be explained in detail hereunder. As the coloring source, the coloring component A contained in the microcapsules and the achromic compound that reacts with the coloring component A to generate the color (the compound B, the compound C, or the compound D; referred to as the "compound to cause the coloring" hereinafter in some cases) are contained in the recording material. As the combination of two components (the coloring component A and the compound to cause the coloring) as the coloring source, preferably following combinations (1) to (18) may be listed (in the following examples, the former denotes the coloring component and the latter denotes the compound to cause the coloring respectively).

(1) The combination of electron-donating dye precusor and electron accepting compound.

(2) The combination of diazonium salt compound and coupling component (appropriately referred to as the "coupler compound" hereinafter).

(3) The combination of organic acid metal salt such as silver behenate, silver stearate, or the like and reducing agent such as protocatechin acid, siroindan, hydroquinone, or the like.

(4) The combination of long-chain fatty acid iron salt such as ferric stearate, ferric myristate, or the like and phenol series such as tannic acid, gallic acid, ammonium salicylate, or the like.

(5) The combination of organic acid heavy metal salt of nickel, cobalt, lead, copper, iron, mercury, or silver salt such as acetic acid, stearic acid, palmitic acid, or the like, and alkaline metal or alkaline earth metal sulfide such as calcium sulfide, strontium sulfide, potassium sulfide, or the like, or the combination of the organic acid heavy metal salt and organic chelating agent such as s-diphenylcarbazide, diphenylcarbazone, or the like.

(6) The combination of heavy metal sulfate such as sulfate, etc. of silver, lead, mercury, sodium, or the like and sulfur compound such as sodium tetrathionate, soda thiosulfate, thiourea, or the like.

(7) The combination of aliphatic iron (III) salt such as ferric stearate, or the like and aromatic polyhydrooxy compound such as 3, 4-hydroxy teteraphenolmethane, or the like.

(8) The combination of organic acid matal salt such as silver oxalate, mercury oxalate, or the like and organic polyhydroxy compound such as polyhydroxy alcohol, glycerin, glycol, or the like.

(9) The combination of fatty acid iron (III) salt such as ferric pelargonate, ferric laurate, or the like and thiosecylcarbamide or isothiosecylcarbamide derivative.

(10) The combination of organic acid lead salt such as lead caproate, lead pelargonate, lead behenate, or the like and thiourea derivative such as ethylene thiourea, N-dodecyl thiourea, or the like.

(11) The combination of higher aliphatic heavy-metal salt such as ferric stearate, copper stearate, or the like and lead dialkyldithiocarbamate.

(12) The combination of resorcin and nitroso compound to form oxazine dye.

(13) The combination of formazan compound and reducing agent and/or metal salt.

(14) The combination of protected pigment (or leuco pigment) precursor and deblocking agent.

(15) The combination of oxidizing coloring agent and oxidizing agent.

(16) The combination of phthalonitryl series and diiminoisoindoline series (the combination to generate phthalocyanine).

(17) The combination of isocyanate series and diiminoisoindoline series (the combination to generate the coloring pigment).

(18) The combination of pigment precursor and acid or base (the combination to generate the pigment).

Figure 12:
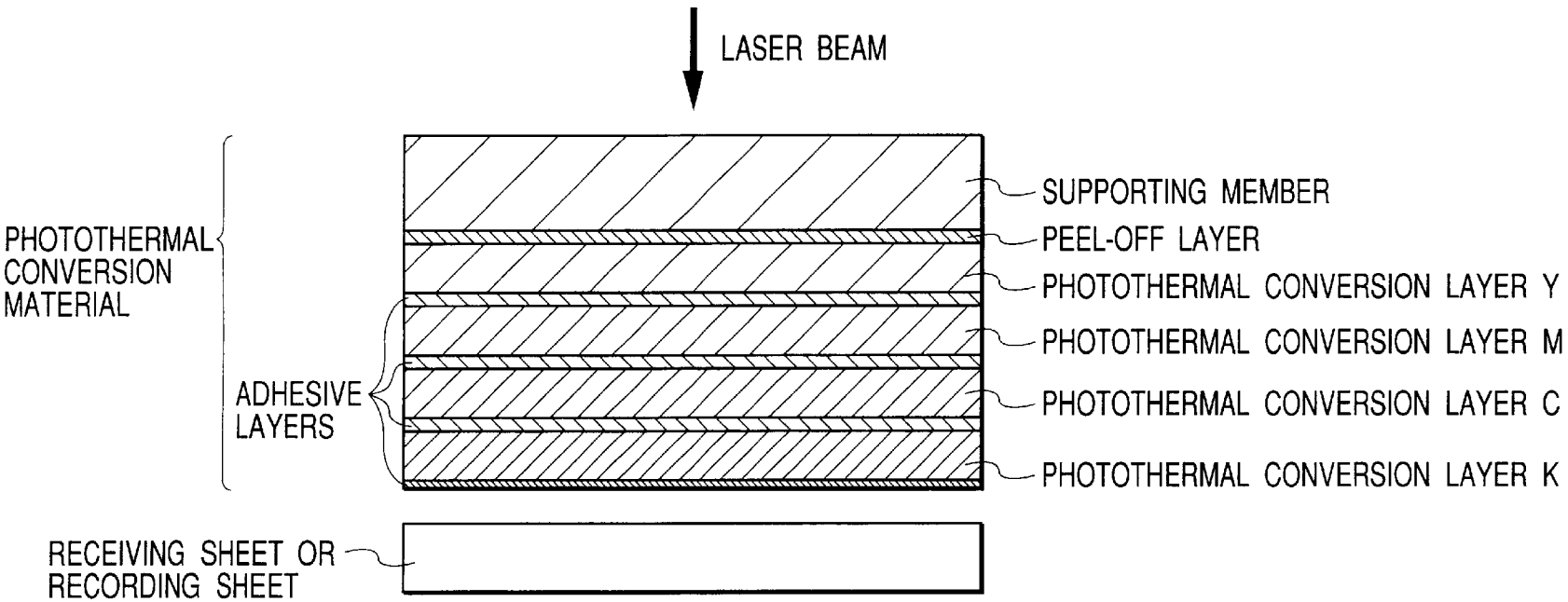
FIG. 12 shows a sectional view of a recording medium using a multi-layered photosensitive thermal transferring recording medium.

The structure of the recording medium in the above photon mode is shown in FIG. 12. The recording medium shown in FIG. 12 consists of the photosensitive thermal transferring material and the image receiving paper (or the present paper) as the image receiving sheet.

The photosensitive thermal transferring material consists of respective K·C·M·Y color layers from the image receiving paper side, and is constructed such that the adhesive layer is provided under respective K·C·M·Y color layers and the peeling layer is provided on the color layer side of the supporting body. Such multi-color type recording medium is referred to as the multi-layered photosensitive thermal transferring recording medium hereinafter. In this case, the order of respective color layers is set as K·C·M·Y from the image receiving paper side. But it is of course that the order of the color layers is not limited to this. Also, the number of layers is not limited to four layers, two layers (two-color printing of M/C) or three layers (three-color printing of M/C/Y. The mixed color of CMY is used as K.) may be employed. In addition, sometimes four layers or more (particularly, gray, green, orange, gold, silver, etc.) may be employed.

This recording medium can be employed in the recording apparatus in FIG. 11 like the heat-mode sensitive material.

First, the image receiving paper (or the present paper) is provided from the image receiving sheet roller 130 of the image receiving sheet supplying portion 100 to the recording drum 300, and then the photosensitive thermal transferring material is taken out from the photosensitive sheet supplying portion 200 and then is wrapped to overlap with the image receiving paper (or the present paper) such that the photosensitive thermal transferring layer can be adhered tightly. Then, the image is recorded independently in respective colors based on image data by the recording head (laser light) 350 having the wavelength (any wavelength in 300 to 1100 nm) to fit to the absorption wavelengths of the photosensitive thermal transferring layers of respective colors. In this case, the laser recording near the wavelength of about 830 nm may be carried out by the K data, the laser recording near the wavelength of about 650 nm may be carried out by the C data, the laser recording near the wavelength of about 530 nm may be carried out by the M data, and the laser recording near the wavelength of about 400 nm may be carried out by the Y data. Of course, wavelengths are not particularly limited to these. If four colors of K·C·M·Y are exposed simultaneously by the above laser lights, the recording time can be reduced to ¼. For example, since the Y/M/C-layers seldom absorb the wavelength of about 830 nm in K-recording, the optical loss is small and the light reaches the K-layer and then the light is absorbed by the K-layer, so that the latent image is formed. Since the Y/M-layers seldom absorb the wavelength of about 650 nm in C-recording, the optical loss is small and the light reaches the C-layer and then the light is sufficiently absorbed by the C-layer, so that the latent image is formed. The minute light having the wavelength of 650 nm, that cannot be absorbed by the C-layer, is seldom absorbed by the K-layer. As a result, the latent image is formed in the predetermined area of the predetermined recording layer, to which the laser light is irradiated. In this laser exposure, the image is exposed/recorded by employing the parallelgram optical shutters according to the present invention, etc. such that the clearance in the optical quantity distribution is not formed between the pixels in the subscanning direction.

Only the supporting body and the adhesive layer are peeled off after the exposure/recording, and thus only the photosensitive thermal transferring layer is left on the image receiving paper or the present paper side. Then, the image receiving paper or the present paper is exhausted onto the sheet exhausting portion (tray) 440.

Then, when the latent image is developed by applying the heat after the image receiving paper or the present paper is taken out, only the portion onto which the laser light is irradiated does not cause the coloring reaction but the non-irradiated portion generates the color. After this, the image receiving paper or the present paper loses the optical reactivity to the recording laser light or the disturbance light (the fluorescent lamp, etc.).

As set forth in Patent Application No. Hei 11-36308 Latent Application Publication (KOKAI) Hei 2000-199952), the spectral sensitization pigment in the photosensitive thermal transferring layer is decolored by the light irradiation by virtue of the lamp, etc. Finally, four-color recording image of K·C·M·Y is formed on the image receiving paper or the present paper.

After this, in order to protect the image from the scratch, etc., the step of forming the surface protection layer may be applied onto the photosensitive thermal transferring layer Y.

In this manner, the recording of the recording medium in the photon mode is carried out by the recording apparatus.

With the above, according to the present invention, the pixel shapes formed by respective optical shutters, etc. are set to the parallelogram and also the alignment of the parallelograms is set to partially overlap with the recording loci of the parallelogram pixels formed by the adjacent optical shutters when the scanning is executed in the main scanning direction, or the pixels of the optical shutters having the rectangular windows, etc. are arranged to be obliquely inclined along the main scanning direction. Therefore, it is possible to carry out the recording in which the clearance of the light quantity distribution is not produced between the pixels in the sub-scanning direction and thus the vertical stripes of the unrecorded portions are generated when the recording is carried out in the main scanning direction and which has no image defect.

What is claimed is:

1. A recording apparatus comprising:

a recording medium fixing member for fixing a recording medium;

a recording medium fixing member moving device for moving the recording medium fixing member by setting a moving direction of the recording medium as a main scanning direction;

a light source for emitting a light beam that is expanded one-dimensionally toward the recording medium fixing member; and an optical shutter device positioned between the light source and the recording medium fixing member and constructed by aligning at least one-dimensionally a number of optical shutters that control passing and reflection of the light beam, whereby recording of the recording medium is carried out by the light beam that is passed through the optical shutters;

wherein pixel shapes formed by respective optical shutters are set to almost rectangles and also $$\theta 1 \leqq \theta 2$$

is satisfied, where θ1 is an angle between a line D connecting an upper right portion A of an n-th pixel and a lower left portion B of an n+1-th pixel and a line E connecting the lower left portion B of the n+1-th pixel and an upper left portion C of the n+1-th pixel, and θ2 is an angle between a one-dimensional alignment direction of the optical shutters that are inclined along the main scanning direction and a sub-scanning direction.

2. A recording apparatus comprising:

a recording medium fixing member for fixing a recording medium;

a recording medium fixing member moving device for moving the recording medium fixing member by setting a moving direction of the recording medium as a main scanning direction;

a light source for emitting a light beam that is expanded one-dimensionally toward the recording medium fixing member; and an optical shutter device positioned between the light source and the recording medium fixing member and constructed by aligning at least one-dimensionally a number of optical shutters that control passing and reflection of the light beam, whereby recording of the recording medium is carried out by the light beam that is passed through the optical shutters;

wherein pixel shapes formed by respective optical shutters are set to parallelograms and also the optical shutter device, by which the clearances are produced between recording loci of parallelogram pixels formed by adjacent optical shutters in a sub-scanning direction, is arranged to be rotated such that an angle θ3 between a line connecting an acute angle portion H on a right side of an n-th pixel and an acute angle portion J on a left side of an n+1-th pixel and a sub-scanning direction axis exceeds 90 degree.

3. A recording apparatus according to any one of claims 1 to 2, wherein the recording medium is formed of heat-mode sensitive material that is constructed by laminating a toner layer of a transfer sheet and an image receiving layer of an image receiving sheet.

4. A recording method of recording an image onto a recording medium by a light beam that passes through optical shutters, comprising steps of:

fixing the recording medium onto a recording medium fixing member, causing the recording medium fixing member by a recording medium fixing member moving device to move in a moving direction of the recording medium being set as a main scanning direction, emitting a light beam, that expands one-dimensionally, from a light source to the recording medium fixing member, and arranging an optical shutter device, that is constructed by aligning a large number of optical shutters at least one-dimensionally, between the light source and the recording medium fixing member to control a passing or a reflection of the light beam, wherein pixel shapes of respective optical shutters are formed as almost rectangles and, if an angle between a line D connecting an upper right portion A of an n-th pixel and a lower left portion B of an n+1-th pixel and a line E connecting the lower left portion B of the n+1-th pixel and an upper left portion C of the n+1-th pixel is set as θ1 and an angle between a one-dimensionally aligned direction of the optical shutters inclined to the main scanning direction and a sub-scanning direction is set as θ2, $$\theta 1 \leqq \theta 2$$

is satisfied.

5. A recording method of recording an image onto a recording medium by a light beam that passes through optical shutters, comprising steps of:

fixing the recording medium onto a recording medium fixing member, causing the recording medium fixing member by a recording medium fixing member moving device to move in a moving direction of the recording medium being set as a main scanning direction, emitting a light beam, that expands one-dimensionally, from a light source to the recording medium fixing member, and arranging an optical shutter device, that is constructed by aligning a large number of optical shutters at least one-dimensionally, between the light source and the recording medium fixing member to control a passing or a reflection of the light beam, wherein pixel shapes of respective optical shutters are formed as parallelograms and an optical shutter device, in which clearances are formed between recording loci of parallelogram pixels formed by neighboring optical shutters in a sub-scanning direction, is arranged to rotate such that an angle θ3 between a line connecting an acute angle portion H on a right side of an n-th pixel and an acute angle portion J on a left side of an n+1-th pixel and a sub-scanning direction axis is set to 90 degree or more.

6. A recording method according to any one of claims 4 to 5, wherein heat-mode sensitive material that is constructed by laminating a toner layer of a transfer sheet and an image receiving layer of an image receiving sheet is employed as the recording medium.

* * * * *